US009051904B2

(12) United States Patent
Nishikawa

(10) Patent No.: US 9,051,904 B2
(45) Date of Patent: Jun. 9, 2015

(54) ENGINE

(75) Inventor: Hiroyasu Nishikawa, Osaka (JP)

(73) Assignee: Yanmar Co., Ltd., Osaka (JP)

( * ) Notice: Subject to any disclaimer, the term of this patent is extended or adjusted under 35 U.S.C. 154(b) by 337 days.

(21) Appl. No.: 13/643,460

(22) PCT Filed: Feb. 17, 2011

(86) PCT No.: PCT/JP2011/053390

§ 371 (c)(1),
(2), (4) Date: Nov. 9, 2012

(87) PCT Pub. No.: WO2011/135898

PCT Pub. Date: Nov. 3, 2011

(65) Prior Publication Data

US 2013/0206121 A1 Aug. 15, 2013

(30) Foreign Application Priority Data

Apr. 30, 2010 (JP) ..... 2010-105059
Apr. 30, 2010 (JP) ..... 2010-105796

(51) Int. Cl.
*F02M 25/07* (2006.01)
*F02M 37/00* (2006.01)
*F02M 25/00* (2006.01)

(52) U.S. Cl.
CPC ..... *F02M 25/0754* (2013.01); *F02M 37/0047* (2013.01); *F02M 25/0752* (2013.01)

(58) Field of Classification Search
CPC F02M 25/0754; F02M 37/0047; F02M 25/07
USPC ..... 123/568.13, 568.11, 568.25, 568.27; 701/108
See application file for complete search history.

(56) References Cited

U.S. PATENT DOCUMENTS

| | | | | |
|---|---|---|---|---|
| 6,796,169 | B2 | 9/2004 | Makino et al. | |
| 2004/0007054 | A1 | 1/2004 | Makino et al. | |
| 2008/0149079 | A1 * | 6/2008 | Jefford et al. | 123/568.11 |
| 2010/0081347 | A1 | 4/2010 | Koide et al. | |

FOREIGN PATENT DOCUMENTS

| | | |
|---|---|---|
| JP | 62-298653 | 12/1987 |
| JP | 2-43447 | 3/1991 |
| JP | 6-146915 | 5/1994 |
| JP | 9-324624 | 12/1997 |
| JP | 10-159679 | 6/1998 |
| JP | 2004-044440 | 2/2004 |
| JP | 2004-301113 | 10/2004 |
| JP | 2008-223525 | 9/2008 |
| JP | 2010-059916 | 3/2010 |
| JP | 2010-077920 | 4/2010 |

* cited by examiner

*Primary Examiner* — Mahmoud Gimie
(74) *Attorney, Agent, or Firm* — Jordan and Hamburg LLP

(57) ABSTRACT

An engine includes an EGR apparatus which refluxes a portion of exhaust gas from an exhaust manifold to an intake manifold as EGR gas. A differential pressure sensor detects a differential pressure between intake pressure of the intake manifold and exhaust pressure in the exhaust manifold. The differential pressure sensor is mounted on a head cover which covers an upper portion of a cylinder head. An intake pressure taking-out passage which is in communication with the intake manifold is formed in the cylinder head. An intake pressure introducing passage which is connected to the differential pressure sensor is formed in the head cover. The intake pressure taking-out passage and the intake pressure introducing passage are in communication with each other.

10 Claims, 21 Drawing Sheets

ENGINE

BACKGROUND OF THE INVENTION

The present invention relates to an engine including an EGR apparatus (exhaust gas recirculation apparatus) which refluxes a portion of exhaust gas from an exhaust system to an intake system as EGR gas.

Conventionally, as countermeasures against exhaust gas of a diesel engine and the like, there is known a technique for lowering combustion temperature and reducing an amount of NOx (nitrogen oxides) in exhaust gas by an EGR apparatus (exhaust gas recirculation apparatus) which refluxes a portion of exhaust gas from an exhaust system to an intake system. In an engine including this kind of EGR apparatus, there is also known a technique for correcting an opening degree of an EGR valve existing in a refluxing passage which connects the exhaust system and an intake system to each other based on differential pressure (differential pressure of intake/exhaust gas) between intake pressure and exhaust pressure (see Patent Documents 1 and 2 for example).

CITATION LIST

Patent Document 1: Japanese Utility Model Application Laid-open No. H2-43447

Patent Document 2: Japanese Patent Application Laid-open No. 2010-59916

SUMMARY OF THE INVENTION

A general differential pressure sensor which detects differential pressure of intake/exhaust gas is supported by an engine through a fixing stay. In this case, the differential pressure sensor is fastened, through a bolt, to the stay fixed to the engine. An intake manifold and the differential pressure sensor are communicated with and connected to each other through an intake pressure taking-out pipe, and an exhaust manifold and the differential pressure sensor are communicated with and connected to each other through an exhaust pressure taking-out pipe.

However, since there exists a large number of accessory machines, pipes, wires and the like around the engine in addition to the differential pressure sensor, it is very troublesome to assemble the stay and the differential pressure sensor while avoiding these elements, and there is room for improvement in terms of assembling operability. There is also a problem that cost is increased in terms of the number of assembling man-hours and the number of parts.

It is a first technical object of the invention of the application to provide an improved engine in view of such circumstances.

An engine mounted in an operating machine is configured to discriminate between cylinders based on a combination of a crank angle signal which is output from a crank angle sensor in accordance with rotation of a crankshaft and a cam angle signal which is output from a cam angle sensor in accordance with rotation of a cam shaft, and inject and ignite fuel in every cylinder based on the result of discrimination. The engine is driven by the injection and ignition of fuel in every cylinder in this manner (see Japanese Patent Application Laid-open No. 2004-4440, for example). Here, the discrimination between cylinders means to specify a crank angle (rotation position) of a crankshaft in one cycle (720° CA) in an engine.

In an engine of this kind, a flywheel which rotates integrally with the crankshaft is disposed on one side surface (called as rear surface of engine for the sake of convenience of explanation) in a direction of the crankshaft. A crank angle sensor is disposed near an outer periphery of a crankshaft pulser which is mounted on the flywheel. As the crankshaft rotates, a to-be detected portion of the crankshaft pulser passes through a location in the vicinity of the crank angle sensor and according to this movement, the crank angle sensor outputs a crank angle signal.

A crank gear fixed to the crankshaft and a cam gear fixed to the cam shaft are disposed on a front surface side (the other side in the direction of the crankshaft) of the engine. The cam gear and the cam shaft are rotated in conjunction with the crank gear, and a valve mechanism which is associated with the cam shaft is driven, thereby opening and closing an intake valve and an exhaust valve of the engine. A earn angle sensor as rotation angle detecting means is disposed on the side of an outer periphery of a cam shaft pulser mounted on the cam gear. As the cam shaft rotates, a to be detected portion of the earn shaft pulser passes through a location in the vicinity of the cam angle sensor and accordingly, the cam angle sensor outputs a cam angle signal.

The cam shaft and the cam gear are elements which constitute a gear train of the engine, and the gear train is accommodated in a gear case fixed to a front surface side of the engine. The cam angle sensor which detects a rotation angle of the can gear (earn shaft) is fitted to a through hole formed in an outer surface of the gear case such that the cam angle sensor faces the cam shaft pulser. Hence, a base portion (portion connected to harness) of the cam angle sensor is exposed outside of the gear case.

According to the conventional configuration, however, since the base portion of the cam angle sensor is exposed outside of the gear case, there is a problem that foreign matters such as trash and stones spattered from the ground hit against the base portion of the cam angle sensor and the cam angle sensor is broken or damaged.

A sound insulation cover body is mounted on the engine or an engine room mounted in the operating machine for suppressing noise, for example. When the sound insulation cover body is mounted directly on the engine, an upper surface of the engine is covered with the sound insulation cover body or the sound insulation cover body is superposed on and fixed to an outer surface of the gear case in which the gear train of the engine is accommodated in many cases.

Attention is focused on the existence of the sound insulation cover body, and it is a second technical object of the invention of the application to provide an improved engine capable of protecting rotation angle detecting means which is mounted on a gear case.

A first aspect of the present invention provides an engine comprising an EGR apparatus which refluxes a portion of exhaust gas from an exhaust system to an intake system as EGR gas, wherein differential pressure detecting means which detects differential pressure between intake pressure in the intake system and exhaust pressure in the exhaust system is mounted on a head cover which covers an upper portion of a cylinder head, an intake pressure taking-out passage which is in communication with the intake system is formed in the cylinder head, an intake pressure introducing passage which is connected to the differential pressure detecting means is formed in the head cover, and the intake pressure taking-out passage and the intake pressure introducing passage are in communication with each other.

According to the invention of a second aspect, in the engine described in the first aspect, the intake pressure introducing passage includes a vertically oriented vertical introducing passage formed in a sidewall of the head cover, and a laterally oriented lateral introducing passage formed in an upper wall of the head cover, and the lateral introducing passage is formed by forming a case hole in molding dies such that the lateral introducing passage extends in parallel to a breather passage formed in the head cover.

According to the invention of a third aspect, in the engine described in the first or second aspect, the differential pressure detecting means and the exhaust system are in communication with each other through an external exhaust pressure taking-out pipe, and the exhaust pressure taking-out pipe is installed such that it faces a cooling fan disposed on one side surface of a cylinder block.

According to the invention of a fourth aspect, in the engine described in the third aspect, the differential pressure detecting means is mounted on an upper surface of the head cover at a location close to the cooling fan.

According to the invention of a fifth aspect, in the engine described in the first aspect, a gear case in which a gear train is accommodated is mounted on one side surface of the cylinder block in a direction of a crankshaft, the engine includes rotation angle detecting means which detects a rotation angle of rotation gears which constitute the gear train, a sound insulation cover body for insulating noise is mounted on an outer surface of the gear case, a swelling portion which swells in a direction separating away from the gear case is formed on the sound insulation cover body, and the rotation angle detecting means is disposed in an accommodating space which is surrounded by the gear case and the swelling portion.

According to the invention of a sixth aspect, in the engine described in the fifth aspect, the swelling portion of the sound insulation cover body is opened upward.

According to the invention of a seventh aspect, in the engine described in the fifth or sixth aspect, a fan shaft which rotatably and pivotally supports a cooling fan is provided on one side surface of the cylinder block above the gear case, one end of the crankshaft outwardly projects from the gear case, and the swelling portion of the sound insulation cover body is located between the fan shaft and one end of the crankshaft.

According to the invention of an eighth aspect, in the engine described in the seventh aspect, a rotation force from the crankshaft is transmitted, through an endless belt, to the cooling fan and an alternator disposed on a side of the fan shaft, and the swelling portion is located in a region of the sound insulation cover body which is surrounded by the endless belt.

A first aspect of the present invention provides an engine comprising an EGR apparatus which refluxes a portion of exhaust gas from an exhaust system to an intake system as EGR gas, wherein differential pressure detecting means which detects differential pressure between intake pressure in the intake system and exhaust pressure in the exhaust system is mounted on a head cover which covers an upper portion of a cylinder head, an intake pressure taking-out passage which is in communication with the intake system is formed in the cylinder head, an intake pressure introducing passage which is connected to the differential pressure detecting means is formed in the head cover, and the intake pressure taking-out passage and the intake pressure introducing passage are in communication with each other. Therefore, a stay which is for exclusive use for mounting the differential pressure detecting means and an external pipe for taking intake pressure into the differential pressure detecting means become unnecessary (pipeless). Hence, it is possible to reduce the number of parts for detecting the differential pressure, and to reduce costs. Further, since the number of parts is reduced, the number of assembling man-hours can be reduced, and the assembling operability can be enhanced. A piping structure around the head cover can also be simplified.

According to the invention of a second aspect, in the engine described in the first aspect, the intake pressure introducing passage includes a vertically oriented vertical introducing passage formed in a sidewall of the head cover, and a laterally oriented lateral introducing passage formed in an upper wall of the head cover, and the lateral introducing passage is formed by forming a case hole in molding dies such that the lateral introducing passage extends in parallel to a breather passage formed in the head cover. Therefore, when the head cover is formed by casting work such as die casting, it is possible to form the lateral introducing passage by forming a cast hole at the same angle as that of the breather passage. Hence, it is easy to draw a cast from a mold, and a structure of the casting mold can be simplified. It is possible to easily form the head cover having the intake pressure introducing passage.

According to the invention of a third aspect, in the engine described in the first or second aspect, the differential pressure detecting means and the exhaust system are in communication with each other through an external exhaust pressure taking-out pipe, and the exhaust pressure taking-out pipe is installed such that it faces a cooling fan disposed on one side surface of a cylinder block. Therefore, it is possible to cool exhaust gas taken out from the exhaust system by cooling wind from the cooling fan while the exhaust gas is in the exhaust pressure taking-out pipe. Therefore, an adverse possibility that high temperature exhaust gas exceeding a permissible value is supplied to the differential pressure detecting means is remarkably lowered and thus, it is possible to suppress generation of abnormal conditions or breakdown of the differential pressure detecting means which may be caused by high temperature exhaust gas.

According to the invention of a fourth aspect, in the engine described in the third aspect, the differential pressure detecting means is mounted on an upper surface of the head cover at a location close to the cooling fan. Therefore, it is possible to cool, by the cooling wind from the cooling fan, not only the exhaust pressure taking-out pipe but also the differential pressure detecting means itself. Hence, it is possible to more effectively prevent the generation of abnormal conditions or breakdown of the differential pressure detecting means which may be caused by high temperature exhaust gas.

According to the invention of a fifth aspect, in the engine described in the first aspect, a gear case in which a gear train is accommodated is mounted on one side surface of the cylinder block in a direction of a crankshaft, the engine includes rotation angle detecting means which detects a rotation angle of rotation gears which constitute the gear train, a sound insulation cover body for insulating noise is mounted on an outer surface of the gear case, a swelling portion which swells in a direction separating away from the gear case is formed on the sound insulation cover body, and the rotation angle detecting means is disposed in an accommodating space which is surrounded by the gear case and the swelling portion. Since the sound insulation cover body exists, it is possible to suppress noise from the engine and protect the rotation angle detecting means from foreign matters such as trash and stones spattered from the ground. Therefore, it is possible to effectively prevent the rotation angle detecting means from being broken or damaged by the spattered stones and the like. Since the sound insulation cover body has both an original sound insulating function and a protecting function of the rotation angle detecting means. Therefore, there are merits that a range of functions of the sound insulation cover body is increased, the number of parts is reduced, and costs are reduced.

According to the invention of a sixth aspect, in the engine described in the fifth aspect, the swelling portion of the sound insulation cover body is opened upward. Therefore, a lower side of the rotation angle detecting means is covered with the swelling portion. This configuration exhibits an effect that it is easy to protect the rotation angle detecting means from stones which spatter from bottom up. Further, when a harness is connected to the rotation angle detecting means, the harness is inserted from the opened portion to a downward direction. Therefore, the wiring operability is excellent.

According to the invention of a seventh aspect, in the engine described in the fifth or sixth aspect, a fan shaft which rotatably and pivotally supports a cooling fan is provided on one side surface of the cylinder block above the gear case, one end of the crankshaft outwardly projects from the gear case, and the swelling portion of the sound insulation cover body is located between the fan shaft and one end of the crankshaft. Therefore, the swelling portion which outwardly swells can be disposed effectively utilizing a dead space between the fan shaft and the one end of the crankshaft while avoiding interference with the cooling fan and the like. A harness can be routed to the rotation angle detecting means while avoiding the cooling fan and the like, and the wiring operability is enhanced.

According to the invention of an eighth aspect, in the engine described in the seventh aspect, a rotation force from the crankshaft is transmitted, through an endless belt, to the cooling fan and an alternator disposed on a side of the fan shaft, and the swelling portion is located in a region of the sound insulation cover body which is surrounded by the endless belt. Therefore, the dead space surrounded by the endless belt can effectively be utilized as a disposition space for the swelling portion, and there is an effect that a space can be saved.

DESCRIPTION OF THE PREFERRED EMBODIMENTS

Figure 1:
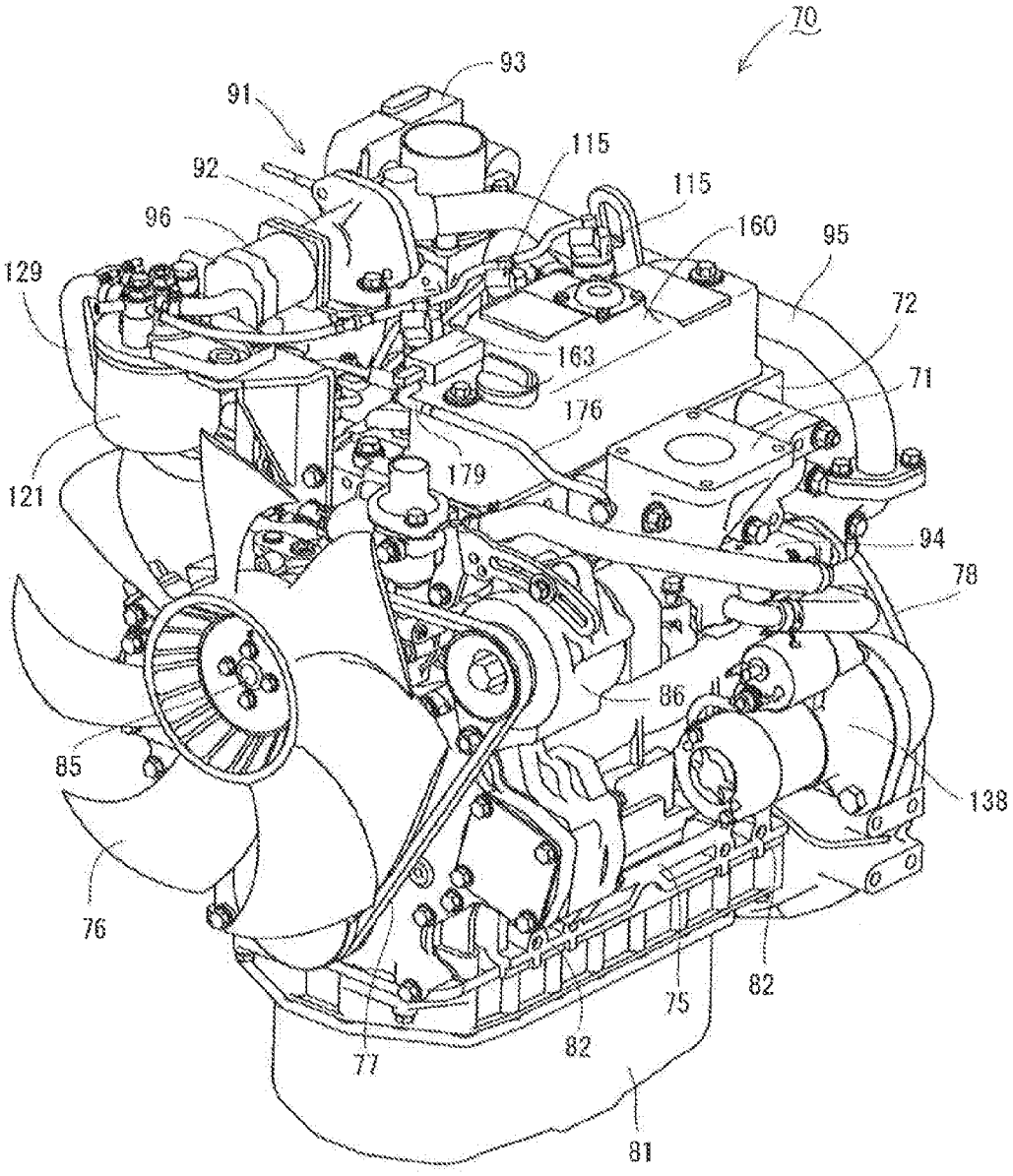
FIG. 1 is a perspective view of an outward appearance of an engine according to a first embodiment.

Embodiments in which the invention of the application is embodied will be described below based on the drawings. In the following description concerning an engine, a side thereof where an intake manifold is installed is called as "right side", a side of the engine where an exhaust manifold is installed is called as "left side", and a positional relation of four directions and upward and downward directions of the engine is based on the "right side" and the "left side" as reference for the sake of convenience.

1. First Embodiment

1-1. Entire Structure of Engine

FIGS. 1 to 10 show a first embodiment of the invention of the application. An entire structure of an engine 70 according to the first embodiment will be described mainly with reference to FIGS. 1 to 6. The engine 70 of the embodiment is a three-cylinder diesel engine, and an exhaust manifold 71 is disposed in a left surface of a cylinder head 72 in the engine 70. An intake manifold 73 is disposed in a right, surface of the cylinder head 72. The cylinder head 72 is mounted on a cylinder block 75 in which crankshafts and pistons (both not shown) are incorporated. Front and rear tip ends of the crankshaft respectively project from both front and rear surfaces of the cylinder block 75. A cooling fan 76 is provided on a front surface of the cylinder block 75. An alternator 86 as a generator is disposed on a left side of the cooling fan 76. The alternator 86 generates electric power by power of the engine 70. A rotation force is transmitted from a front end of the crankshaft to the cooling fan 76 and the alternator 86 through a V-belt 77 as an endless belt.

As shown in FIGS. 1 to 4, a flywheel housing 78 is fixed to a rear surface of the cylinder block 75. A flywheel 79 is disposed in the flywheel housing 78. The flywheel 79 is pivotally supported by a rear end of the crankshaft. The flywheel 79 rotates integrally with the crankshaft. Power of the engine 70 is transmitted, through the flywheel 79, to a driving portion of an operating machine such as a backhoe and a forklift.

A starter (motor) 138 having an output shaft, includes a pinion gear (not shown) is mounted on a left side of the flywheel housing 78. The pinion gear of the starter 138 meshes with a ring gear (not shown) of the flywheel 79. When the engine 70 is started, the ring gear of the flywheel 79 is rotated by a rotation force of the starter 138. According to this rotation, the crankshaft starts rotating (so-called cranking).

An oil pan 81 is disposed on a lower surface of the cylinder block 75. Engine leg-mounting portions 82 are respectively provided on left and right surfaces of the cylinder block 75 and on left and right surfaces of the flywheel housing 78. Engine leg bodies 83 including vibration isolation rubbers are fastened to the engine leg-mounting portions 82 through bolts. The engine 70 is supported, in a vibration isolating manner, by an engine support chassis 84 (see FIGS. 2 and 3) of the operating machine such as the backhoe and the forklift through the engine leg bodies 83.

An air cleaner (not shown) is connected to an inlet of the intake manifold 73 through a collector 92 (see FIGS. 1, 2, 4 and 6) which constitutes an EGR apparatus 91 (exhaust gas recirculation apparatus). Outside air which is dust-removed and purified by the air cleaner is sent to the intake manifold 73 through the collector 92 of the EGR apparatus 91, and supplied to each of the cylinders of the engine 70. As shown in FIGS. 1, 2, 4 and 6, the EGR apparatus 91 includes the collector (EGR body case) 92 which mixes recirculation exhaust gas (exhaust gas, a portion of exhaust gas discharged from exhaust manifold 71) of the engine 70 and new air (outside air from air cleaner) with each other and supplies the mixture gas to the intake manifold 73, a recirculation exhaust gas pipe 95 connected to the exhaust manifold 71 through an EGR cooler 94, and an EGR valve 96 which brings the collector 92 into communication with the recirculation exhaust gas pipe 95.

In the above-described configuration, outside air is supplied from the air cleaner into the collector 92, and EGR gas is supplied from the exhaust manifold 71 into the collector 92 through the EGR valve 96. Outside air from the air cleaner and EGR gas from the exhaust manifold 71 are mixed with each other in the collector 92 and thereafter, the mixture gas in the collector 92 is supplied to the intake manifold 73. That is, a portion of exhaust gas discharged from the engine 70 to the exhaust manifold 71 is refluxed from the intake manifold 73 to the engine 70. According to this reflux, a maximum combustion temperature at the time of high load operation is lowered, and an amount of NOx (nitrogen oxides) discharged from the engine 70 is reduced.

Although it is not illustrated in the drawings, a tail pipe is connected, through a muffler or a diesel particulate filter and the like, to the exhaust manifold 71 mounted on the left surface of the cylinder head 72. That is, exhaust gas discharged from each of the cylinders of the engine 70 to the exhaust manifold 71 is discharge outside from the tail pipe through the muffler or the diesel particulate filter and the like.

1-2. Common-Rail System and Structure of Fuel System of Engine

Next, a common rail system 117 and a fuel system structure of the engine 70 will be described with reference to FIGS. 1 to 7. As shown in FIGS. 2 and 7, a fuel tank 118 is connected to injectors 115 of the three cylinders provided in the engine 70 through the common rail system 117 and a fuel supply pump 116. Each of the injectors 115 includes an electromagnetic open/close control type fuel injection valve 119. The common rail system 117 includes a cylindrical common rail 120.

As shown in FIGS. 1, 2, 6 and 7, the fuel tank 118 is connected to a suction side of the fuel supply pump 116 through a fuel filter 121 and a low pressure pipe 122. Fuel in the fuel tank 118 is sucked into the fuel supply pump 116 through the fuel filter 121 and the low pressure pipe 122. The fuel supply pump 116 of the embodiment is disposed in the vicinity of the intake manifold 73. More specifically, the fuel supply pump 116 is disposed on a side of the right surface of the cylinder block 75 (on a side where intake manifold 73 is installed) and below the intake manifold 73. The common rail 120 is connected to a discharge side of the fuel supply pump 116 through a high pressure pipe 123. The injectors 115 for the three cylinders are connected to the common rail 120 through three fuel injection pipes 126.

In the above-described configuration, fuel in the fuel tank 118 is sent to the common rail 120 under pressure by the fuel supply pump 116, and the high pressure fuel is accumulated in the common rail 120. Opening and closing operations of each of the fuel injection valves 119 are controlled, and high pressure fuel in the common rail 120 is injected from the injectors 115 into the cylinders of the engine 70. That is, by electronically controlling the fuel injection valve 119, injection pressure, injection timing, injection period (injection amount) of fuel supplied from the injectors 115 are precisely controlled. Therefore, it is possible to reduce nitrogen oxides (NOx) discharged from the engine 70, and to reduce noise and vibration of the engine 70.

As shown in FIG. 7, the fuel supply pump 116 is connected to the fuel tank 118 through a fuel return pipe 129. A common rail return pipe 131 is connected to a longitudinal end of the cylindrical common rail 120 through a fuel return connector 130. The fuel return connector 130 limits pressure of fuel in the common rail 120. That is, surplus fuel of the fuel supply pump 116 and surplus fuel of the common rail 120 are collected in the fuel tank 118 through the fuel return pipe 129 and the common rail return pipe 131.

1-3. Mounting Structure of Differential Pressure Sensor of Upper Portion of Engine Next, a mounting structure of a differential pressure sensor 163 existing in an upper portion in the engine 70 will be described with reference to FIGS. 1, 3, 6 and 8 to 10. An upper surface of the cylinder head 72 in the engine 70 is covered with a head cover 160. The head cover 160 is produced by die casting. It is of course possible to produce the head cover 160 by casting other than the die casting. The head cover 160 is fastened to the upper surface of the cylinder head 72 through a bolt. A space in the head cover 160 forms a rocker arm chamber. A breather pipe passage 161 for removing blow-by gas in the engine 70 outwardly projects from a right surface of the head cover 160. The breather pipe passage 161 is communicated with and connected to the intake manifold 73 through a breather hose 162. The blow-by gas in the engine 70 is returned from the breather pipe passage 161 to the intake manifold 73 through the breather hose 162, and the gas is burned again.

Figure 2:
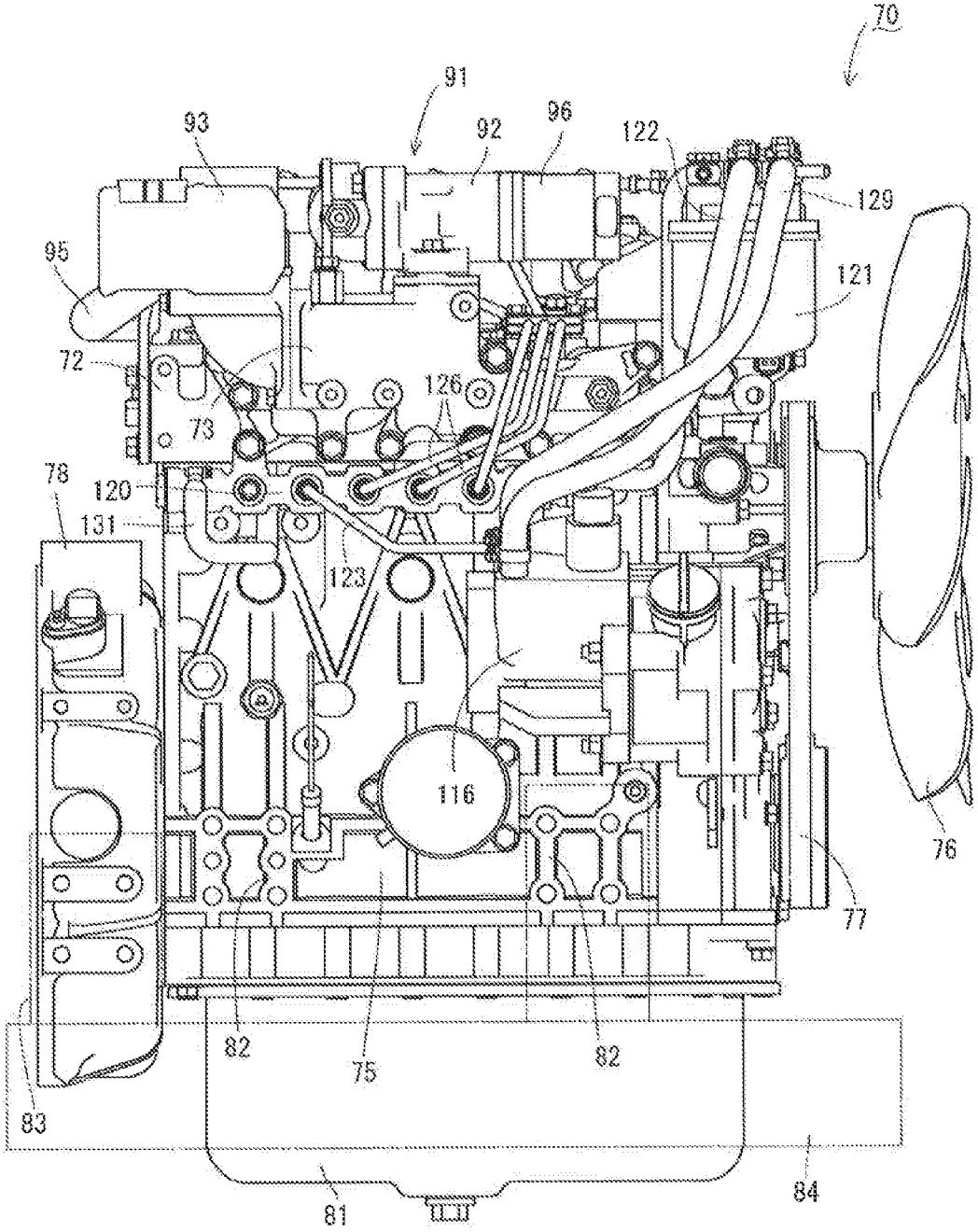
FIG. 2 is a side view of the engine on a side where an intake manifold is installed.
Figure 3:
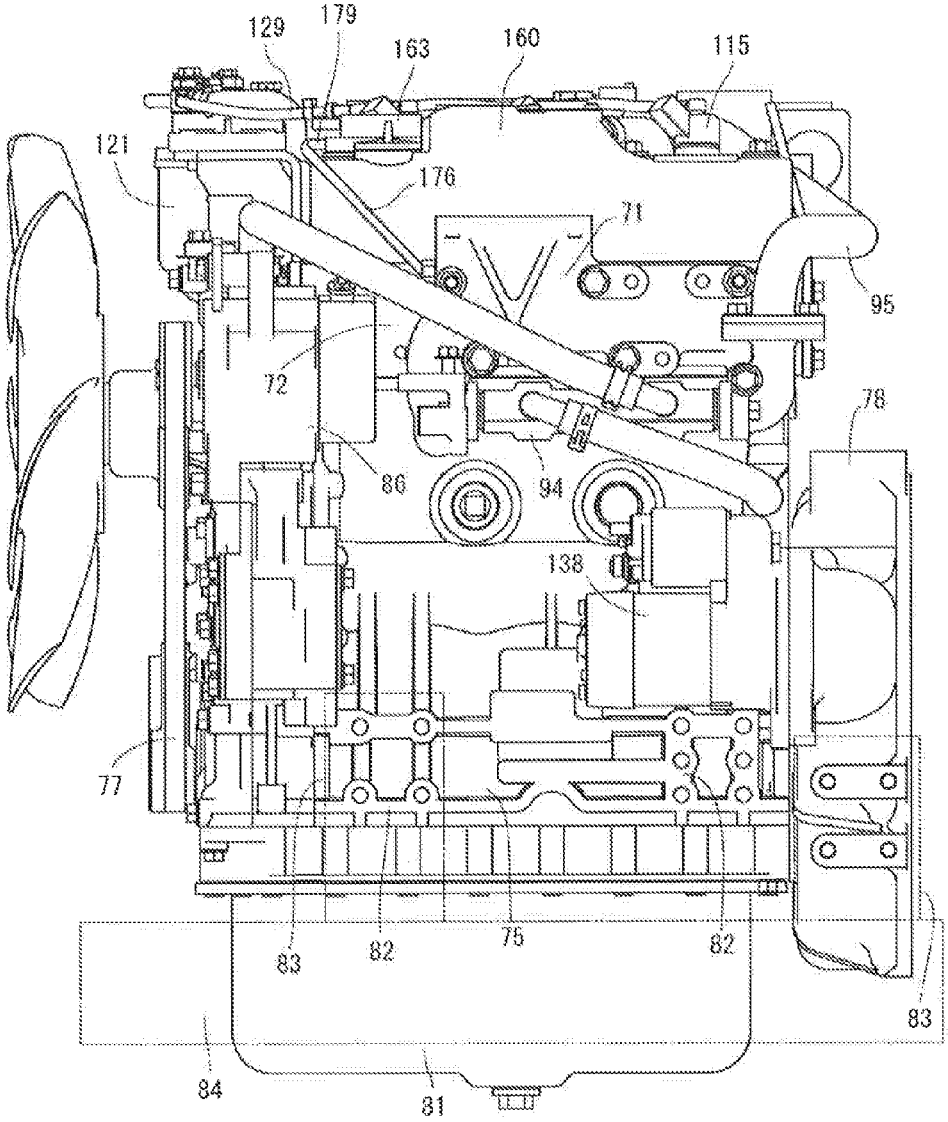
FIG. 3 is a side view of the engine on a side where an exhaust manifold is installed.
Figure 4:
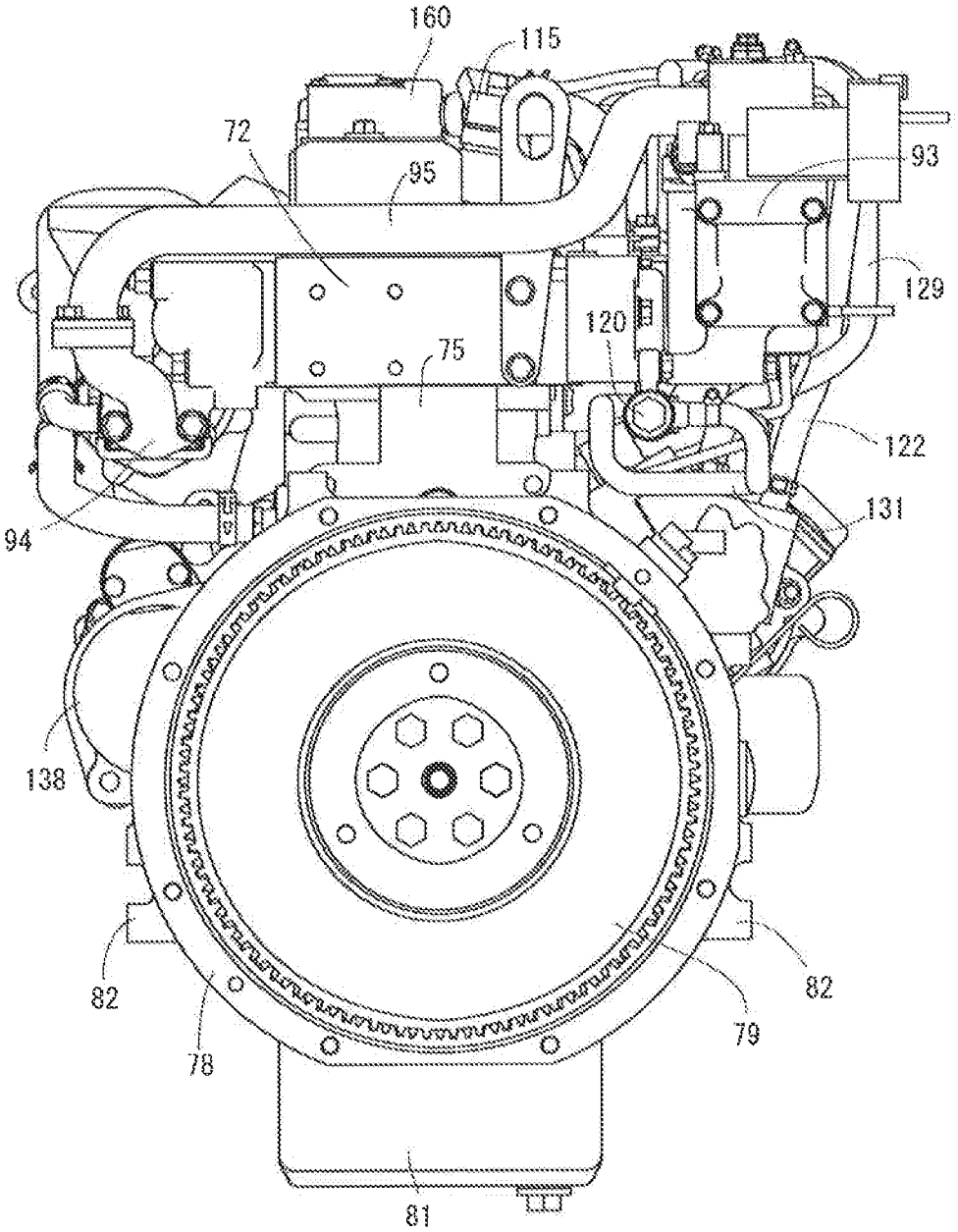
FIG. 4 is a side view of the engine on a side where a flywheel is installed.
Figure 5:
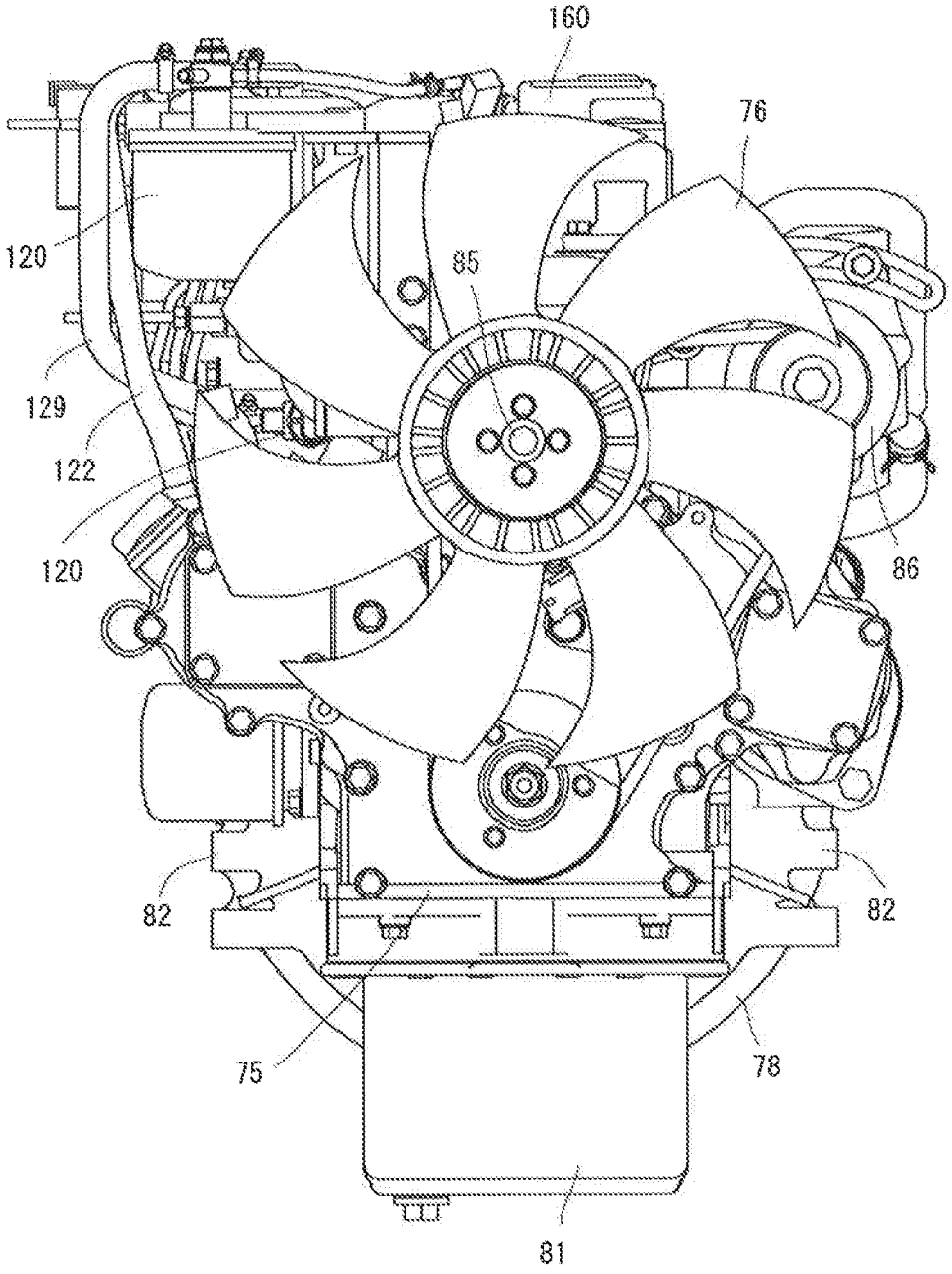
FIG. 5 is a side view of the engine on a side where a cooling fan is installed.
Figure 6:
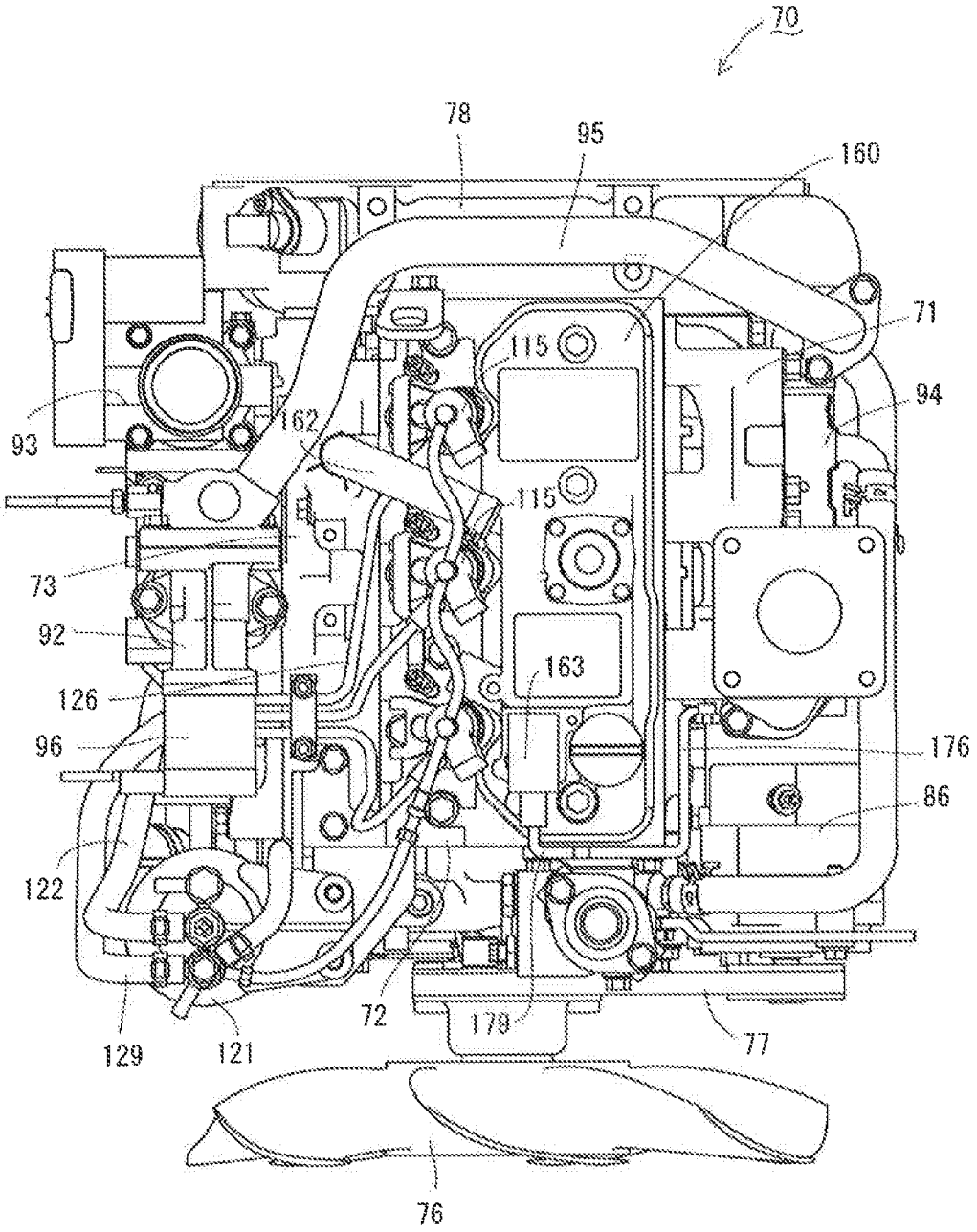
FIG. 6 is a plan view of the engine.
Figure 7:
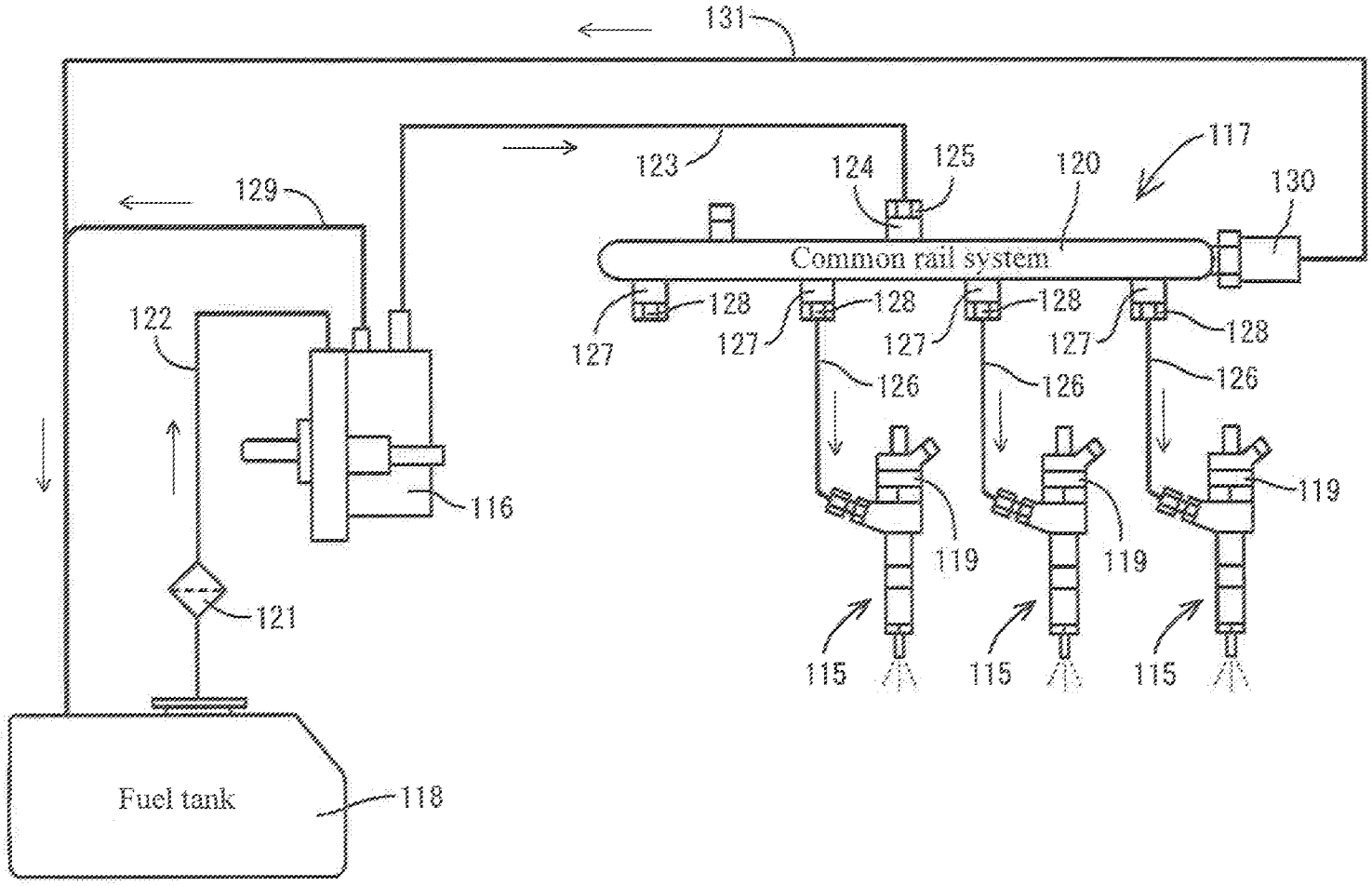
FIG. 7 is an explanatory diagram of a fuel system of the engine.

As shown in FIGS. 1, 3 and 6, the differential pressure sensor 163 as differential pressure detecting means is mounted on an upper surface of the head cover 160 for detecting differential pressure between intake pressure in the intake manifold 73 and exhaust pressure in the exhaust manifold 71. The differential pressure sensor 163 of the embodiment is mounted on a portion of the upper surface of the head cover 160 at a location close to the cooling fan 76. By adjusting an opening degree of the EGR valve 96 based on differential pressure detected by the differential pressure sensor 163, variation of a supply amount of EGR gas (reflux flow rate of EGR gas) caused by variation in the intake pressure and the exhaust pressure is suppressed. As a result, the effect for reducing the amount of NOx discharged from the engine 70 is further enhanced.

Figure 8:
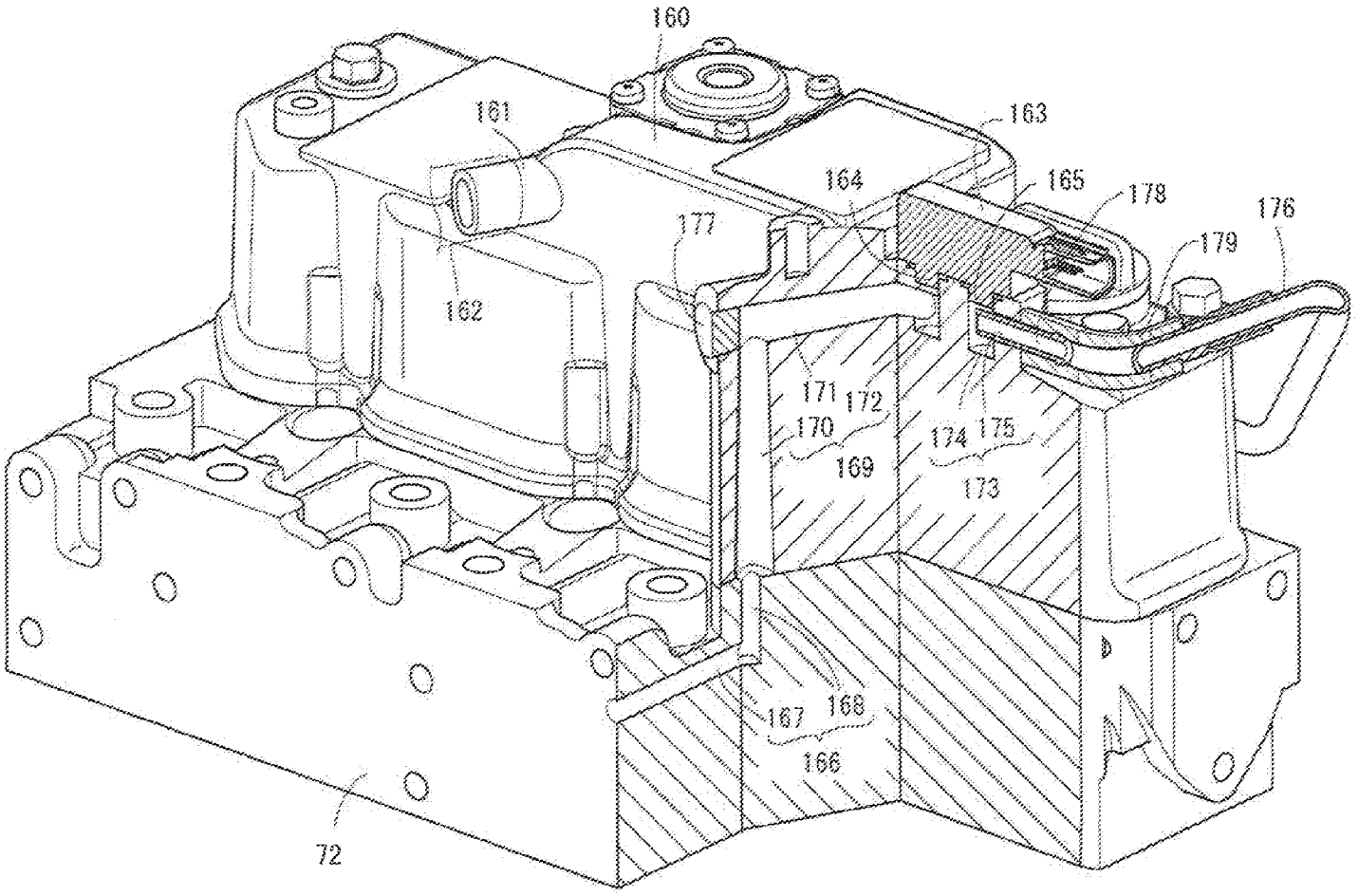
FIG. 8 is a partially cutaway sectional perspective view of an upper portion of the engine for showing a piping structure of a differential pressure sensor.
Figure 9:
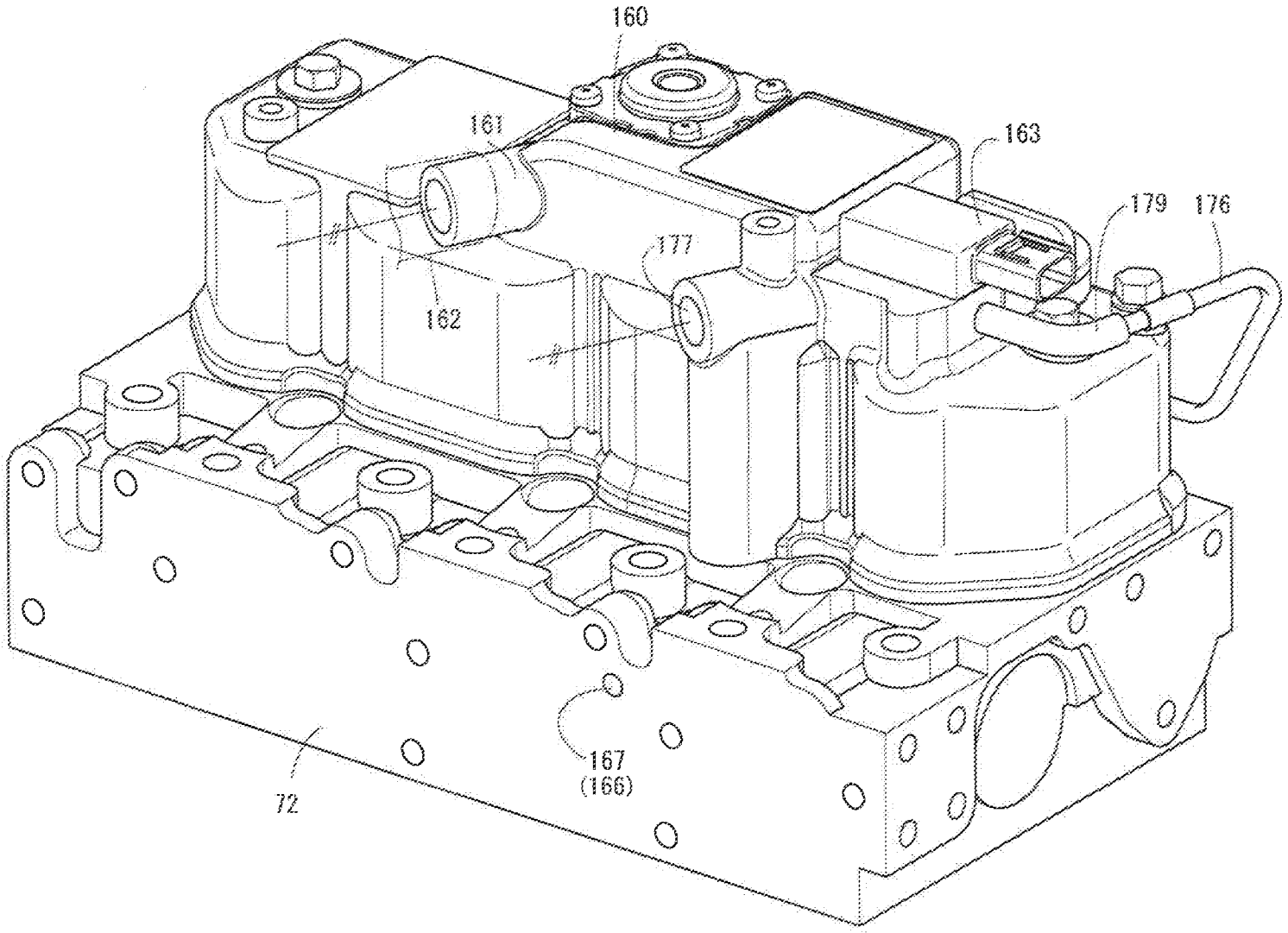
FIG. 9 is a perspective view of the upper portion of the engine for showing a piping structure of the differential pressure sensor.
Figure 10:
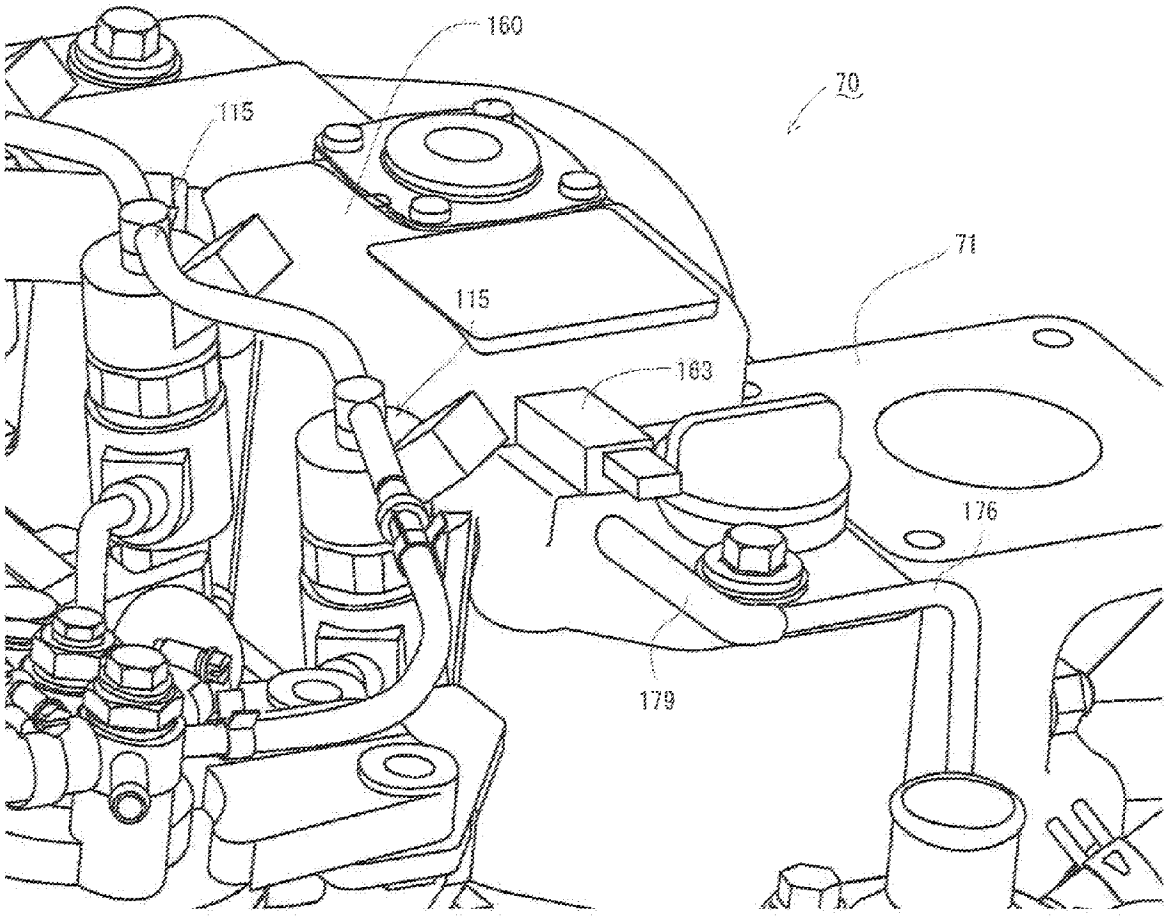
FIG. 10 is an enlarged perspective view of an outward appearance of the upper portion of the engine.
Figure 11:
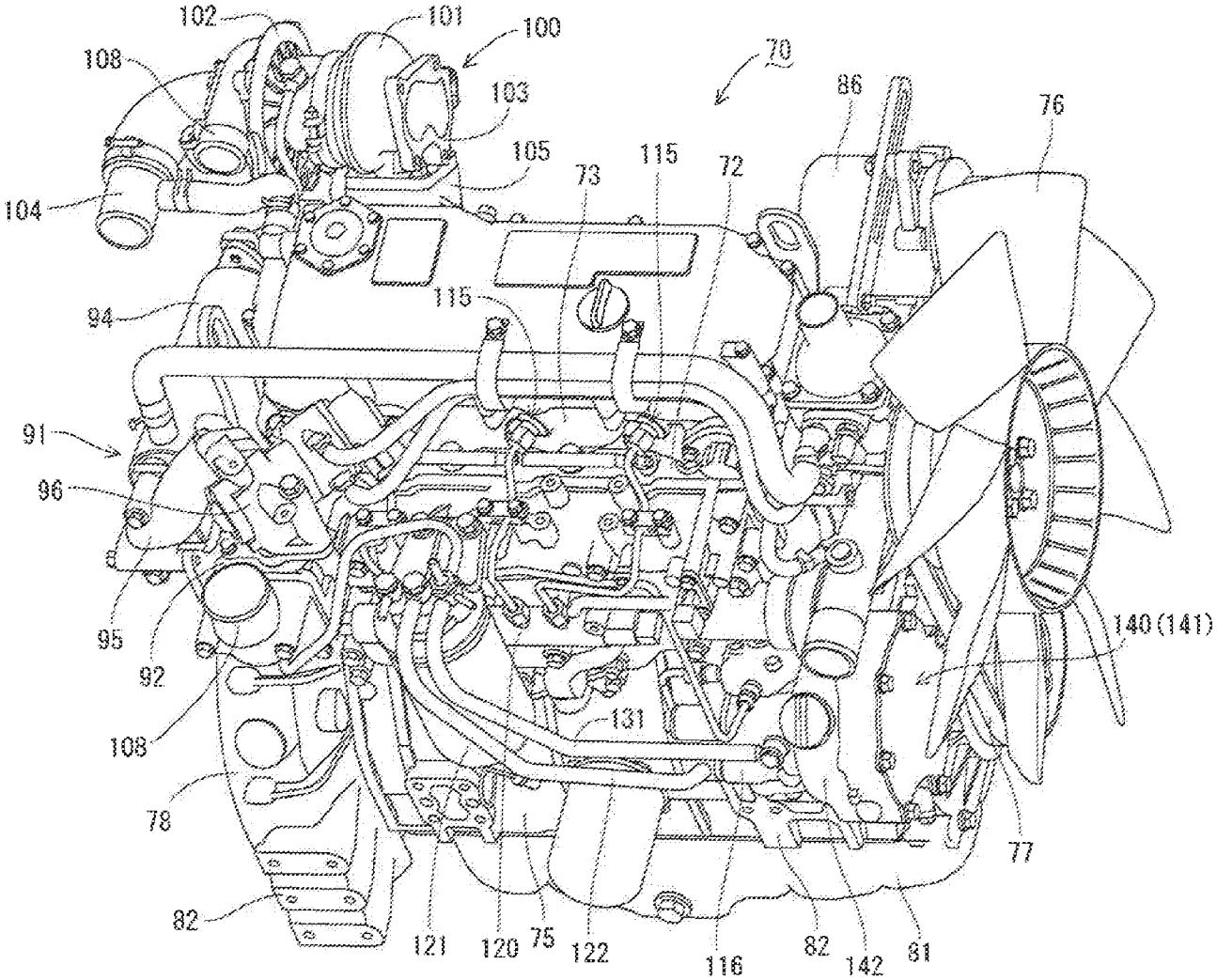
FIG. 11 is a perspective view of an outward appearance of an engine according to a second embodiment.
Figure 12:
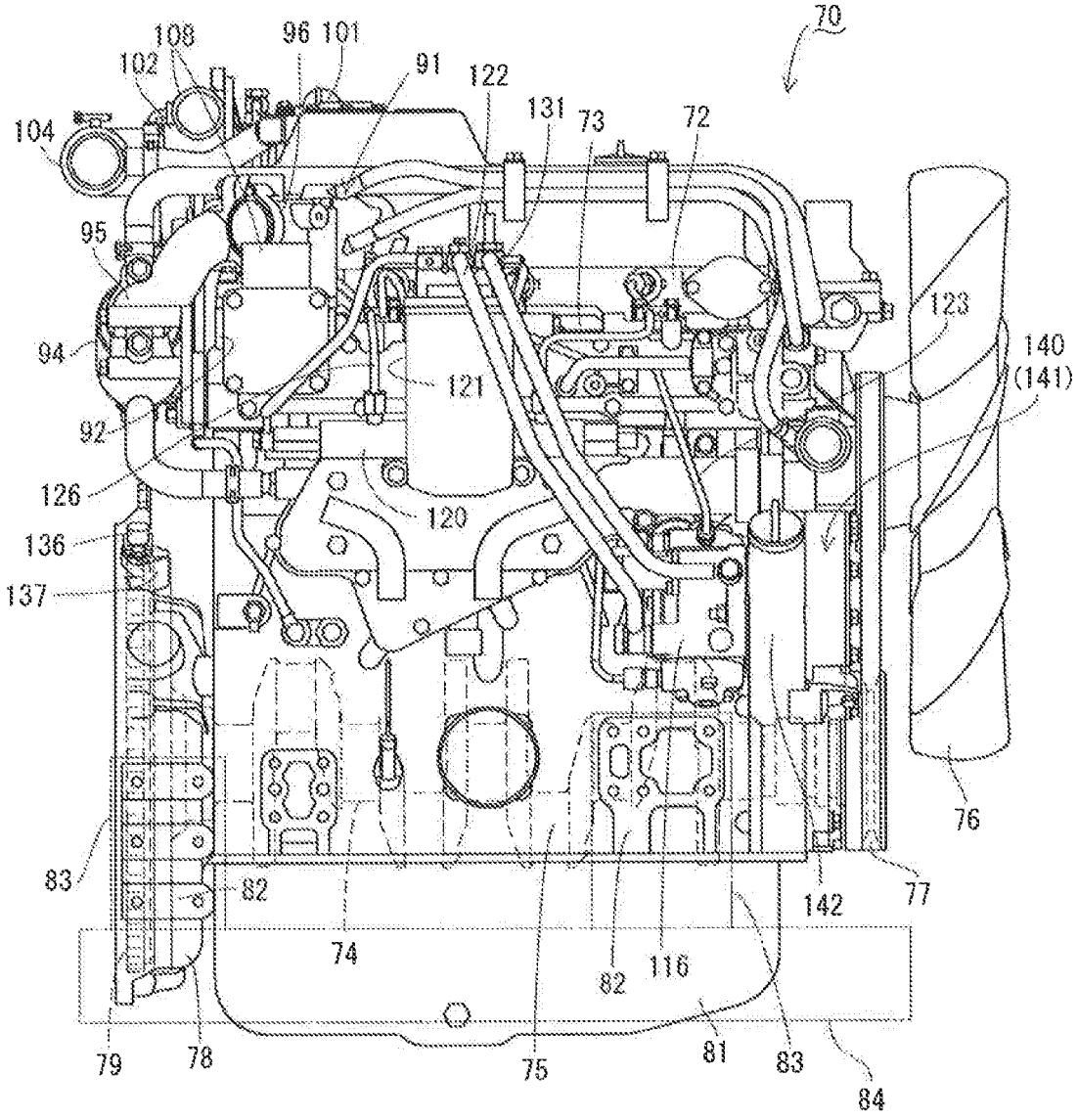
FIG. 12 is a side view of the engine on a side where an intake manifold is installed.
Figure 13:
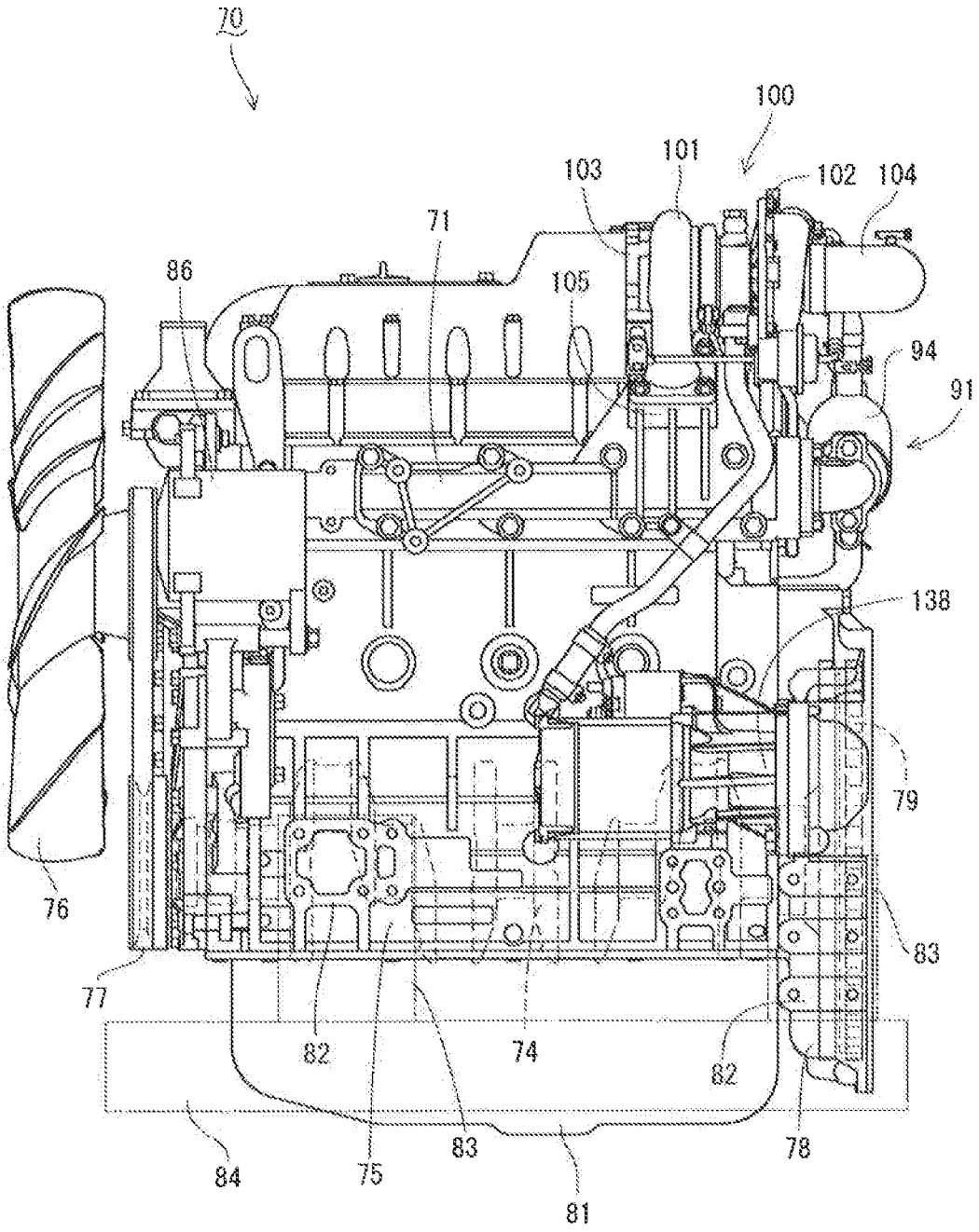
FIG. 13 is a side view of the engine on a side where an exhaust manifold is installed.
Figure 14:
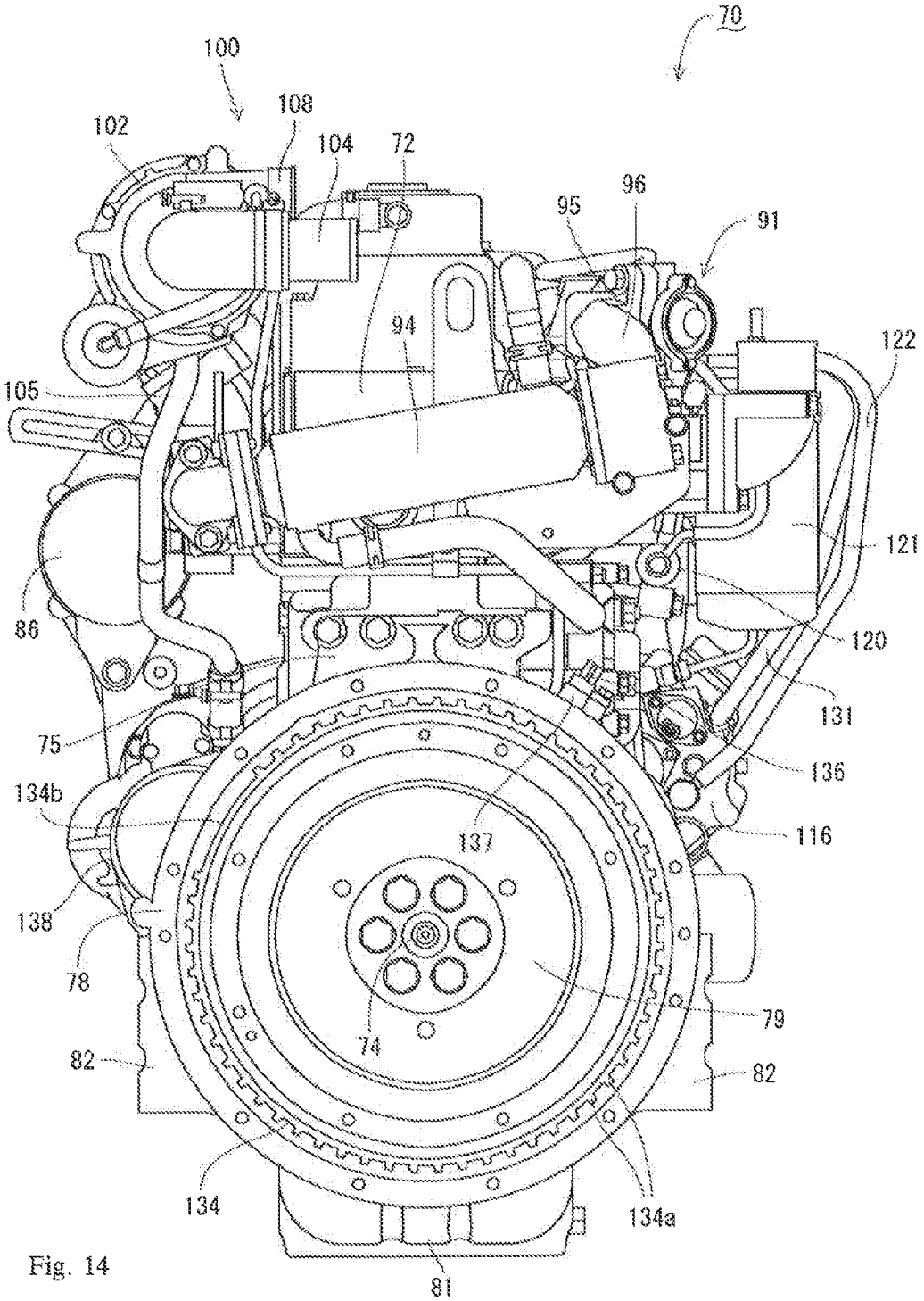
FIG. 14 is a side view of the engine on a side where a flywheel is installed.
Figure 15:
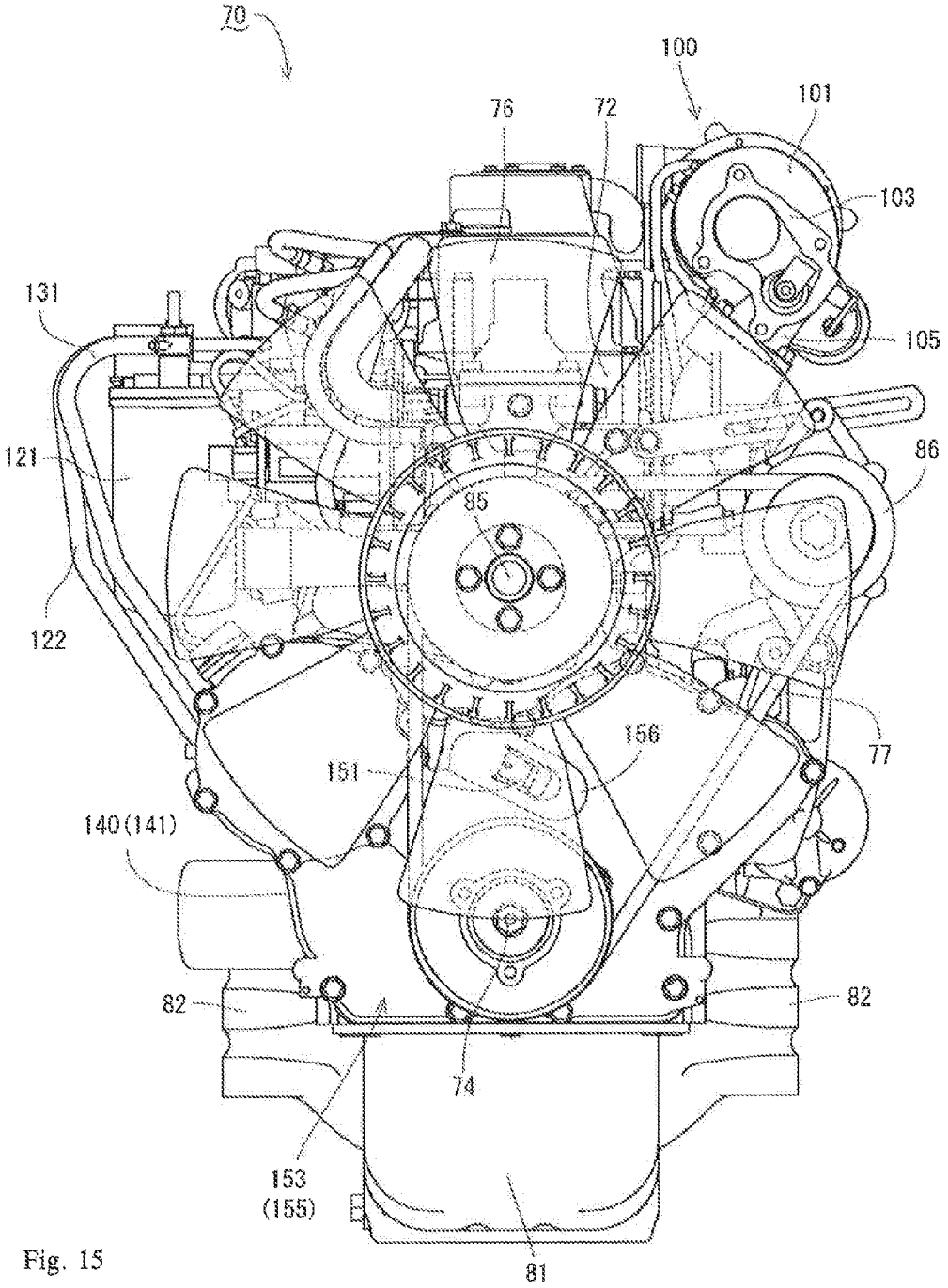
FIG. 15 is a side view of the engine on a side where a cooling fan is installed.
Figure 16:
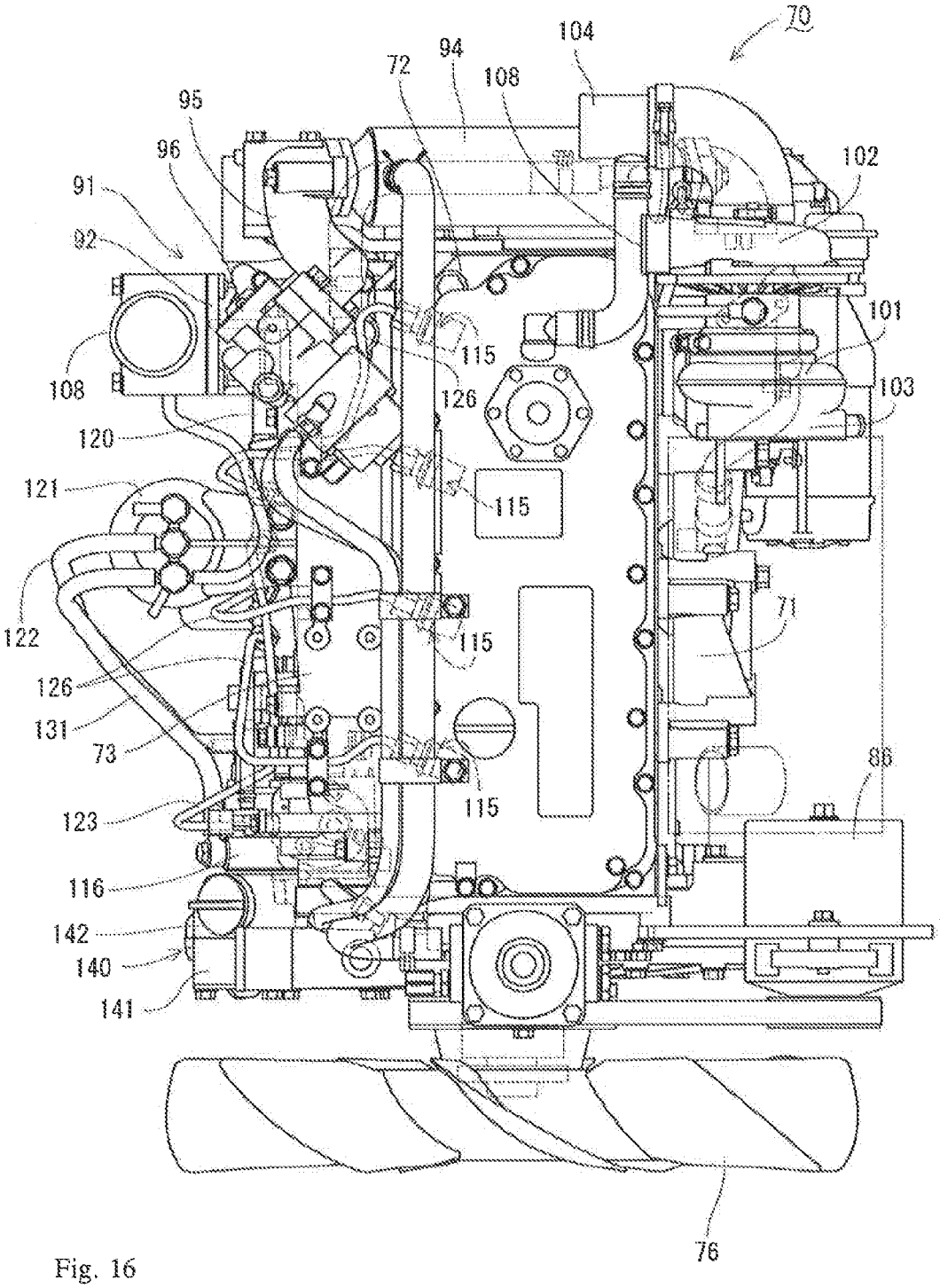
FIG. 16 is a plan view of the engine.
Figure 17:
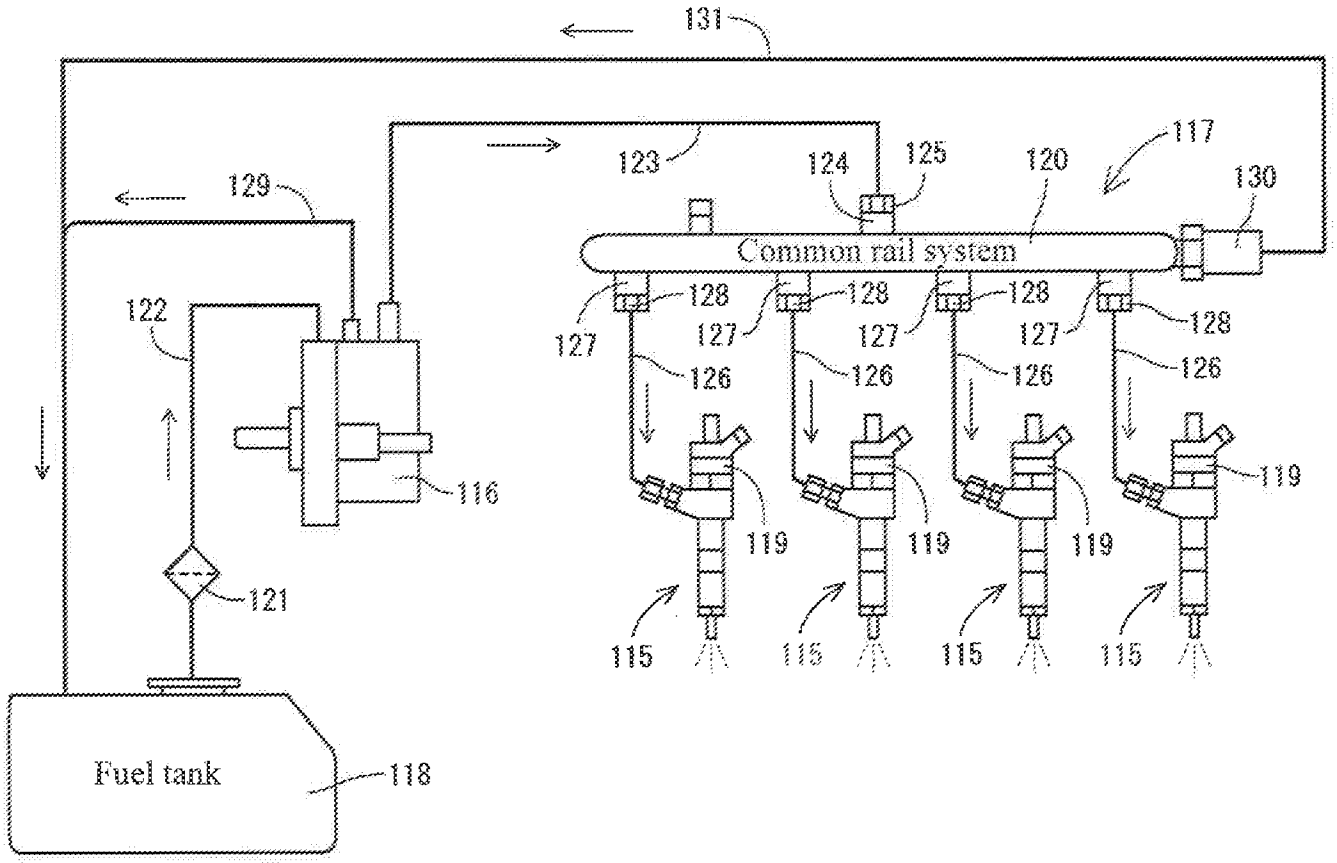
FIG. 17 is an explanatory diagram of a fuel system of the engine.

As shown in FIG. 8, an intake pressure taking-out passage 166 which is in communication with the intake manifold 73 is formed in the cylinder head 72. A cross section of the intake pressure taking-out passage 166 is formed into a substantially L-shape by a laterally oriented lateral taking-out passage 167 and a vertically oriented vertical taking-out passage 168. The lateral taking-out passage 167 opens toward an interior of the intake manifold and the vertical taking-out passage 168 opens toward the intake pressure introducing passage 169.

The intake pressure introducing passage 169 and an exhaust pressure introducing passage 173 are formed in the head cover 160. Of a pair of detecting portions 164 and 165 which downwardly project from the differential pressure sensor 163, the intake pressure introducing passage 169 is connected to the intake pressure detecting portion 164, and the exhaust pressure introducing passage 173 is connected to the exhaust pressure detecting portion 165. A cross section of the intake pressure introducing passage 169 is formed into a substantially L-shape by a vertically oriented vertical introducing passage 170 formed in a right wall 160*a* of the head cover 160, a laterally oriented lateral introducing passage 171 formed in an upper wall 160*b* of the head cover 160, and an intake-side detecting portion passage 172 which upwardly opens from the upper wall 160*b* of the head cover 160. In a state where the head cover 160 is mounted on the cylinder head 72, the intake pressure taking-out passage 166 and the intake pressure introducing passage 169 are in communication with each other.

The exhaust pressure introducing passage 173 includes an exhaust-side detecting portion passage 174 which upwardly opens from the upper wall of the head cover 160, and a communication hole 175 to which an exhaust pressure introducing joint 178 is inserted and fixed. In a state where the differential pressure sensor 163 is mounted on the upper surface of the head cover 160, the intake pressure detecting portion 164 is fitted into the intake-side detecting portion passage 172 from above, and the exhaust pressure detecting portion 165 is fitted into the exhaust-side detecting portion passage 174 from above. One end of a connection rubber pipe 179 is fitted over the exhaust pressure introducing joint 178 inserted and fixed to the communication hole 175 of the exhaust pressure introducing passage 173. One end of an external exhaust pressure taking-out pipe 176 is inserted and attached to the other end of the connection rubber pipe 179. That is, the exhaust pressure introducing joint 178 and the one end of the exhaust pressure taking-out pipe 176 are communicated with and connected to each other through the connection rubber pipe 179. As shown in FIGS. 1 and 6, the other end of the exhaust pressure taking-out pipe 176 is communicated with and connected to the exhaust manifold 71. As shown FIGS. 1, 3 and 6, the exhaust pressure taking-out pipe 176 of the embodiment is installed such that the pipe 176 faces the cooling fan 76 provided on the front surface of the cylinder block 75.

The intake pressure detecting portion 164 of the differential pressure sensor 163 detects pressure of intake as which flows from the intake manifold 73 through the intake pressure taking-out passage 166 and the intake pressure introducing passage 169. The exhaust pressure detecting portion 165 detects pressure of exhaust gas which flows from the exhaust manifold 71 through the exhaust pressure taking-out pipe 176, the exhaust pressure introducing joint 178 and the exhaust pressure introducing passage 173.

The intake pressure introducing passage 169 and the exhaust pressure introducing passage 173 existing on the side of the head cover 160 are formed by forming a case hole in molding dies. Especially, the lateral introducing passage 171 of the intake pressure introducing passage 169 is formed by forming a case hole in molding dies so that the lateral introducing passage 171 extends in parallel to the breather pipe passage 161 which projects from the right surface of the head cover 160. A plug 177 is attached to an opening hole of the lateral introducing passage 171 which opens outward from a right surface of the head cover 160. The plug 177 closes the opening hole.

1-4. Summary of First Embodiment

As apparent from the above description and FIGS. 1, 3, 6 and 8 to 10, an engine 70 comprising an EGR apparatus 91 which refluxes a portion of exhaust gas from an exhaust system 71 to an intake system 73 as EGR gas, wherein differential pressure detecting means 163 which detects differential pressure between intake pressure in the intake system 73 and exhaust pressure in the exhaust system 71 is mounted on a head cover 160 which covers an upper portion of a cylinder head 72, an intake pressure taking-out passage 166 which is in communication with the intake system 73 is formed in the cylinder head 72, an intake pressure introducing passage 169 which is connected to the differential pressure detecting means 163 is formed in the head cover 160, and the intake pressure taking-out passage 166 and the intake pressure introducing passage 169 are in communication with each other. Therefore, a stay which is for exclusive use for mounting the differential pressure detecting means 163 and an external pipe for taking intake pressure into the differential pressure detecting means 163 become unnecessary (pipeless). Hence, it is possible to reduce the number of parts for detecting the differential pressure, and to reduce costs. Further, since the number of parts is reduced, the number of assembling man-hours can be reduced, and the assembling operability can be enhanced. A piping structure around the head cover 160 can also be simplified.

As apparent from the above description and FIGS. 1, 3, 6 and 8 to 10, the intake pressure introducing passage 166 includes a vertically oriented vertical introducing passage 170 formed in a sidewall 160*a* of the head cover 160, and a laterally oriented lateral introducing passage 171 formed in an upper wall 160*b* of the head cover 160, and the lateral introducing passage 171 is formed by forming a case hole in molding dies such that the lateral introducing passage 171 extends in parallel to a breather passage 161 formed in the head cover 160. Therefore, when the head cover 160 is formed by casting work such as die casting, it is possible to form the lateral introducing passage 171 by forming a cast hole at the same angle as that of the breather passage 161. Hence, it is easy to draw a cast from a mold, and a structure of the casting mold can be simplified. It is possible to easily form the head cover 160 having the intake pressure introducing passage 169.

As apparent from the above description and FIGS. 1, 3, 6 and 8 to 10, the differential pressure detecting means 163 and the exhaust system 71 are in communication with each other through an external exhaust pressure taking-out pipe 176, and the exhaust pressure taking-out pipe 176 is installed such that it faces a cooling fan 76 disposed on one side surface of a cylinder block 75. Therefore, it is possible to cool exhaust gas taken out from the exhaust system 71 by cooling wind from the cooling fan 76 while the exhaust gas is in the exhaust pressure taking-out pipe 176. Therefore, an adverse possibility that high temperature exhaust gas exceeding a permissible value is supplied to the differential pressure detecting means 163 is remarkably lowered and thus, it is possible to suppress generation of abnormal conditions or breakdown of the differential pressure detecting means 163 which may be caused by high temperature exhaust gas.

As apparent from the above description and FIGS. 1, 3, 6 and 8 to 10, the differential pressure detecting means 163 is mounted on an upper surface of the head cover 160 at a location close to the cooling fan 76. Therefore, it is possible to cool, by the cooling wind from the cooling fan 76, not only the exhaust pressure taking-out pipe 176 but also the differential pressure detecting means 163 itself. Hence, it is possible to more effectively prevent the generation of abnormal conditions or breakdown of the differential pressure detecting means 163 which may be caused by high temperature exhaust gas.

2. Second Embodiment

FIGS. 11 to 21 show a second embodiment of the invention of the application. A configuration of the second embodiment is basically the same as that of the first embodiment except the number of cylinders, and layout of an EGR apparatus 91 and a turbo supercharger 100. Differences of the second embodiment from the first embodiment will mainly be described.

2-1. Entire Structure of Engine

An entire structure of an engine 70 of the second embodiment will be described mainly with reference to FIGS. 11 to 16. The engine 70 of the embodiment is a four-cylinder diesel engine, and an exhaust manifold 71 is disposed in a left surface of a cylinder head 72 of the engine 70. An intake manifold 73 is disposed in a right surface of the cylinder head 72. The cylinder head 72 is mounted on a cylinder block 75 in which crankshafts 74 and pistons (not shown) are incorporated.

Figure 21:
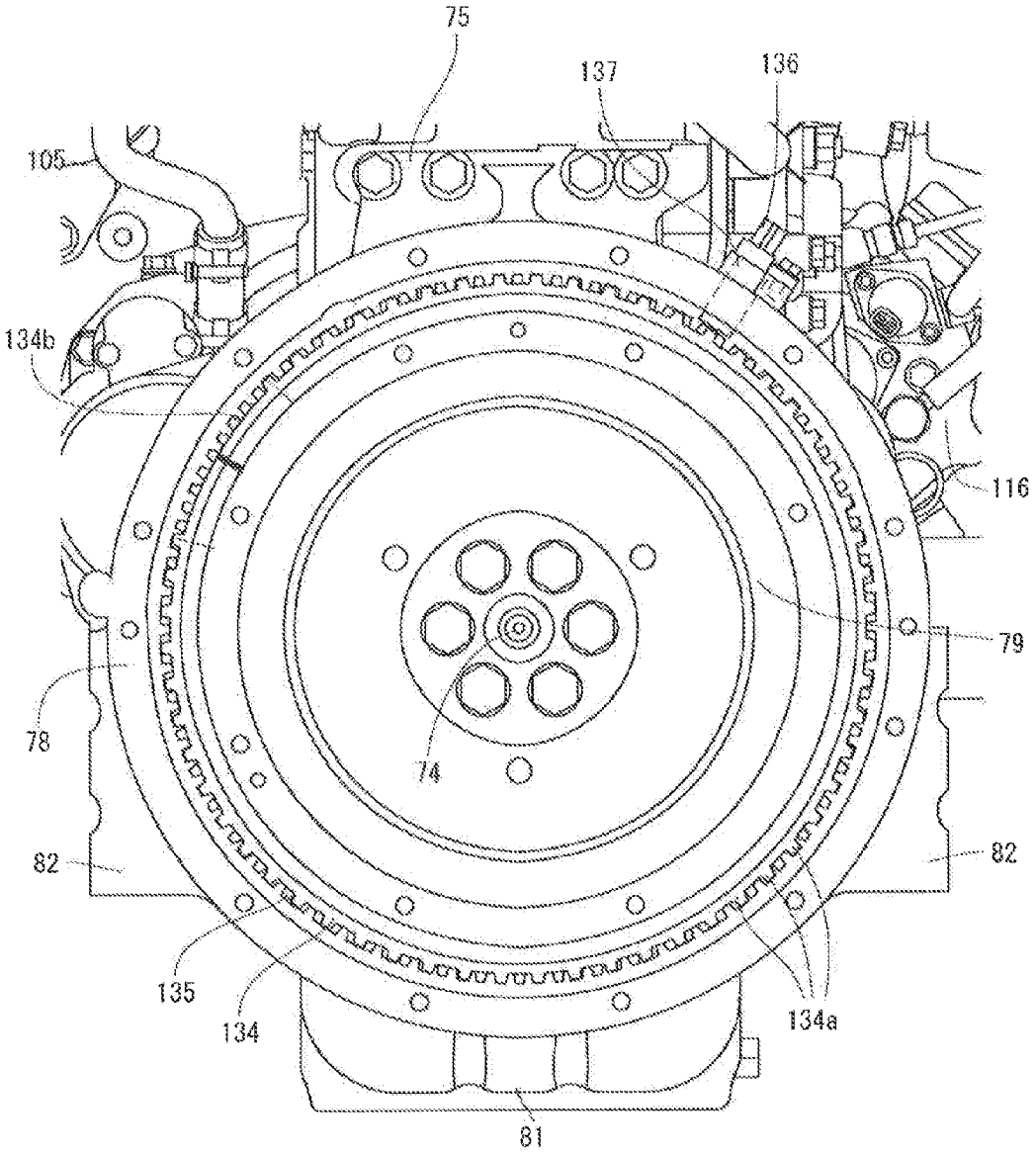
FIG. 21 is an enlarged front view of the flywheel.

As shown in FIG. 21, an annular crankshaft pulser 134 and a ring gear 135 for a starter (motor) 138 are fitted and fixed to an outer periphery of a flywheel 79. Output projections 134*a* as to-be detected portions arranged at predetermined crank angle (rotation angle) from one another are formed on an outer peripheral surface of the crankshaft pulser 134. Chipped-teeth. 134*b* are formed in portions of the outer peripheral surface of the crankshaft pulser 134 corresponding to top dead centers of the first or fourth cylinder for example. A crank angle sensor 136 as crank angle detecting means is disposed near the outer peripheral side of the crankshaft pulser 134 to face the output projections 134*a* and the chipped-teeth 134*b*. The crank angle sensor 136 is for detecting a crank angle (rotation angle) of the crankshaft 74. As the crankshaft 74 rotates, the output projections 134*a* of the crankshaft pulser 134 pass through a location near the crankshaft 74, thereby outputting a crank angle signal. The crank angle sensor 136 of the embodiment can be attached to and detached from a sensor inserting portion 137 formed on a right side of an upper portion of the flywheel housing 78.

Fuel system structures of a common rail system 117 and the engine 70 are the same as those of the first embodiment except those generated based on the difference in the number of cylinders (see FIGS. 11, 12, 16 and 17).

2-2. Gear Train Structure of Engine and Cylinder-Discriminating Structure

Next, a gear train structure of the engine 70 and a cylinder-discriminating structure will be described with reference to FIGS. 15 and 18 to 20. As shown in FIGS. 15 and 18 to 20, a split-type gear case 140 including a case lid 141 and a case body 142 is fixed to a front surface of the cylinder block 75. The gear case 140 of the embodiment is located below a fan shaft 85 which rotatably and pivotally supports a cooling fan 75.

A front end of the crankshaft 74 projecting from a front surface of the cylinder block 75 penetrates the case body 142 of the gear case 140. A crank gear 143 is fixed to a front tip end of the crankshaft 74. A cam shaft 144 extending in parallel to a rotation axis of the crankshaft 74 is rotatably and pivotally supported in the cylinder block 75. The cam shaft 144 of the embodiment is disposed at a portion in the cylinder block 75 closer to its left surface (on the side where exhaust manifold 71 is disposed). Like the crankshaft 74, a front end of the cam shaft 144 also penetrates the case body 142 of the gear case 140. A cam gear 145 is fixed to the front tip end of the cam shaft 144.

A fuel supply pump 116 which is provided on a right surface of the engine 70 includes a pump shaft 146 as a rotation shaft extending in parallel to a rotation axis of the crankshaft 74. Like the crankshaft 74 and the cam shaft 144, a front end of the pump shaft 146 also penetrates the case body 142 of the gear case 140. A pump gear 147 is fixed to the front tip end of the pump shaft 146.

An idle shaft 148 extending in parallel to the rotation axis of the crankshaft 74 is disposed on a portion of the case body 142 surrounded by the crankshaft 74, the cam shaft 144 and the pump shaft 146. The idle shaft 148 of the embodiment penetrates the case body 142 and is fixed to a front surface of the cylinder block 75. An idle gear 149 is rotatably and pivotally supported by the idle shaft 148. The idle gear 149 meshes with three gears, i.e., the crank gear 143, the cam gear 145 and the pump gear 147. A rotation force of the crankshaft 74 is transmitted from the crank gear 143 to both the cam gear 145 and the pump gear 147 through the idle gear 149. Therefore, the cam shaft 144 and the pump shaft 146 rotate in conjunction with the crankshaft 74. In the embodiment, a gear ratio between the gears 143, 145, 147 and 149 is set such that the cam shaft 144 and the pump shaft 146 make one rotation while the crankshaft 74 makes two rotations. The crank gear 143, the cam gear 145, the pump gear 147 and the idle gear 149 are accommodated in the gear case. Therefore, a group of these gears 143, 145, 147 and 149 constitutes the gear train of the engine 70.

Although details are omitted, an intake valve and an exhaust valve provided in the cylinder head 72 are opened and closed by rotating the cam gear 145 and the cam shaft 144 in conjunction with the crank gear 143 which rotates together with the crankshaft 74, and by driving a valve mechanism provided in association with the cam shaft 144. Fuel in the fuel tank 118 is sent to the common rail 120 under pressure and the high pressure fuel is accumulated in the common rail 120 by rotating the pump gear 147 and the pump shaft 146 in conjunction with the crank gear 143, and by driving the fuel supply pump 116.

Figure 20:
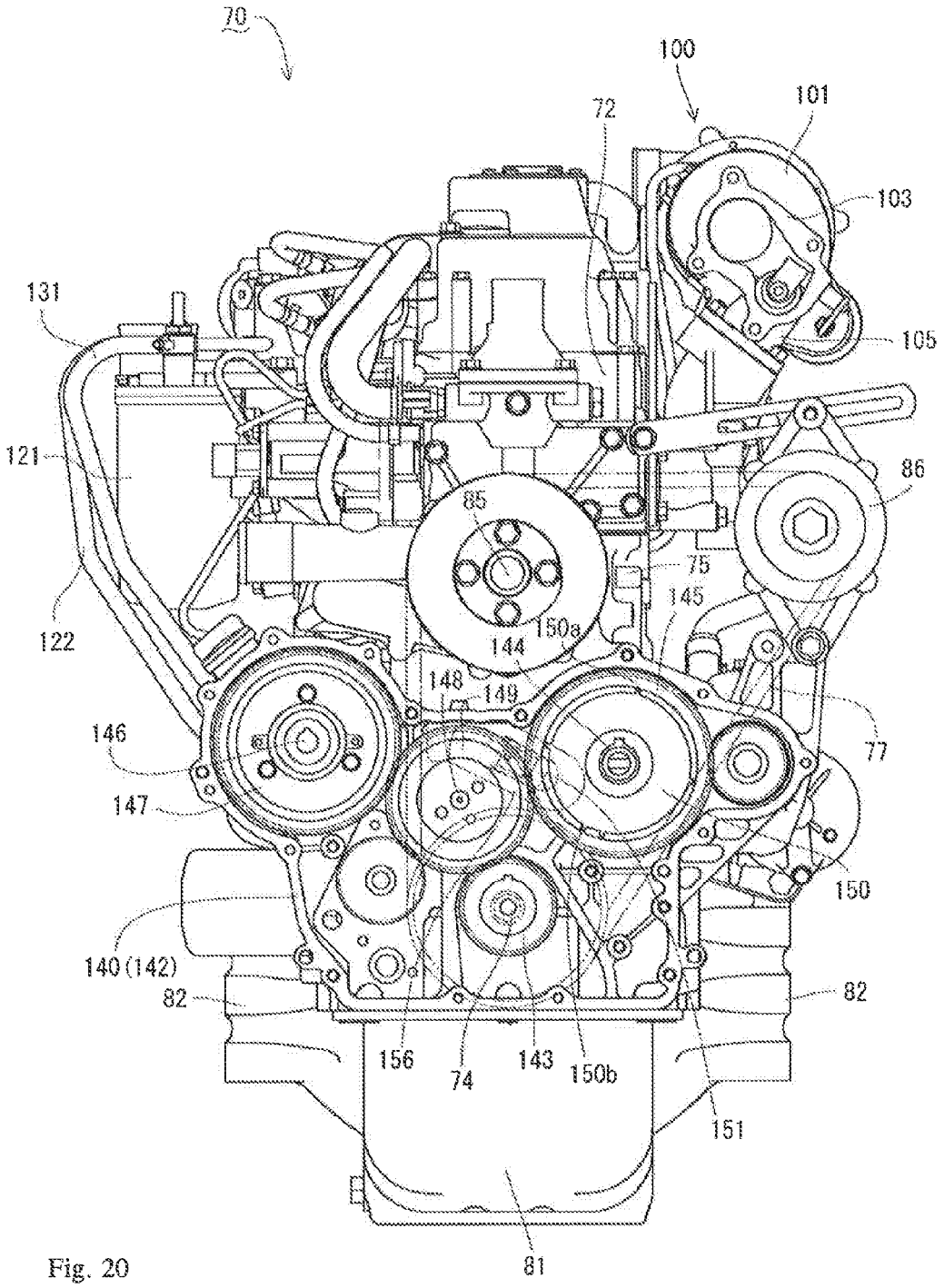
FIG. 20 is a side view showing a gear train of the engine.

As shown in FIG. 20, a cam shaft pulser 150 as rotation angle detecting means is fastened, through a bolt, to a side surface of the cam gear 145 at a location close to the case lid 141 such that the cam shaft pulser 150 integrally rotates with the cam gear 145 (and thus, cam shaft 144). The cam shaft pulser 150 of the embodiment is formed into a doughnut disk shape. Output projections 150*a* as to-be detected portions are formed on an outer peripheral surface of the cam shaft pulser 150 every 90° (every crank angle of 180°). Surplus teeth 150*b* are formed on a circumferential surface of the cam shaft pulser 150 at locations immediately before (upstream of rotation direction) of the output projections 150*a* corresponding to the top dead center of a first cylinder for example. A cam shaft rotation angle sensor 151 as rotation angle detecting means is disposed near the outer peripheral side of the cam shaft pulser 150 to face the output projections 150*a* and the surplus teeth 150*b*. The cam shaft rotation angle sensor 151 is for detecting a rotation angle of the cam shaft 144 (or cam gear). As the cam shaft 144 rotates, the output projections

150*a* and the surplus teeth 150*b* of the cam shaft pulser 150 pass through a location in the vicinity of the cam shaft 144, thereby outputting a rotation angle signal.

A crank angle signal which is output from the crank angle sensor 136 as the crankshaft 74 rotates, and a rotation angle signal which is output from the cam shaft rotation angle sensor 151 as the cam shaft 144 rotates are input to a controller (not shown). The controller discriminates between the cylinders and calculates the crank angle from the above-described various signals, and electronically controls the fuel injection valves 119 based on the calculation result. As a result, injection pressure, injection timing and injection period (injection amount) of fuel supplied from the injectors 115 are precisely controlled.

The cam shaft, rotation angle sensor 151 as the rotation angle detecting means is fitted and attached to a through hole (not shown) formed in a central upper side of the case lid 141. In the embodiment, the through hole formed in the case lid 141 faces the to-be detected portion (output projections 150*a*, surplus teeth 150*b*) of the cam shaft pulser 150. Hence, a tip end of the cam shaft rotation angle sensor 151 fitted and attached to the through hole faces the to-be detected portion of the cam shaft pulser 150 and can detect that the to-be detected portion passes therethrough. A base portion of the cam shaft rotation angle sensor 151 is exposed outside of the case lid 141.

Figure 18:
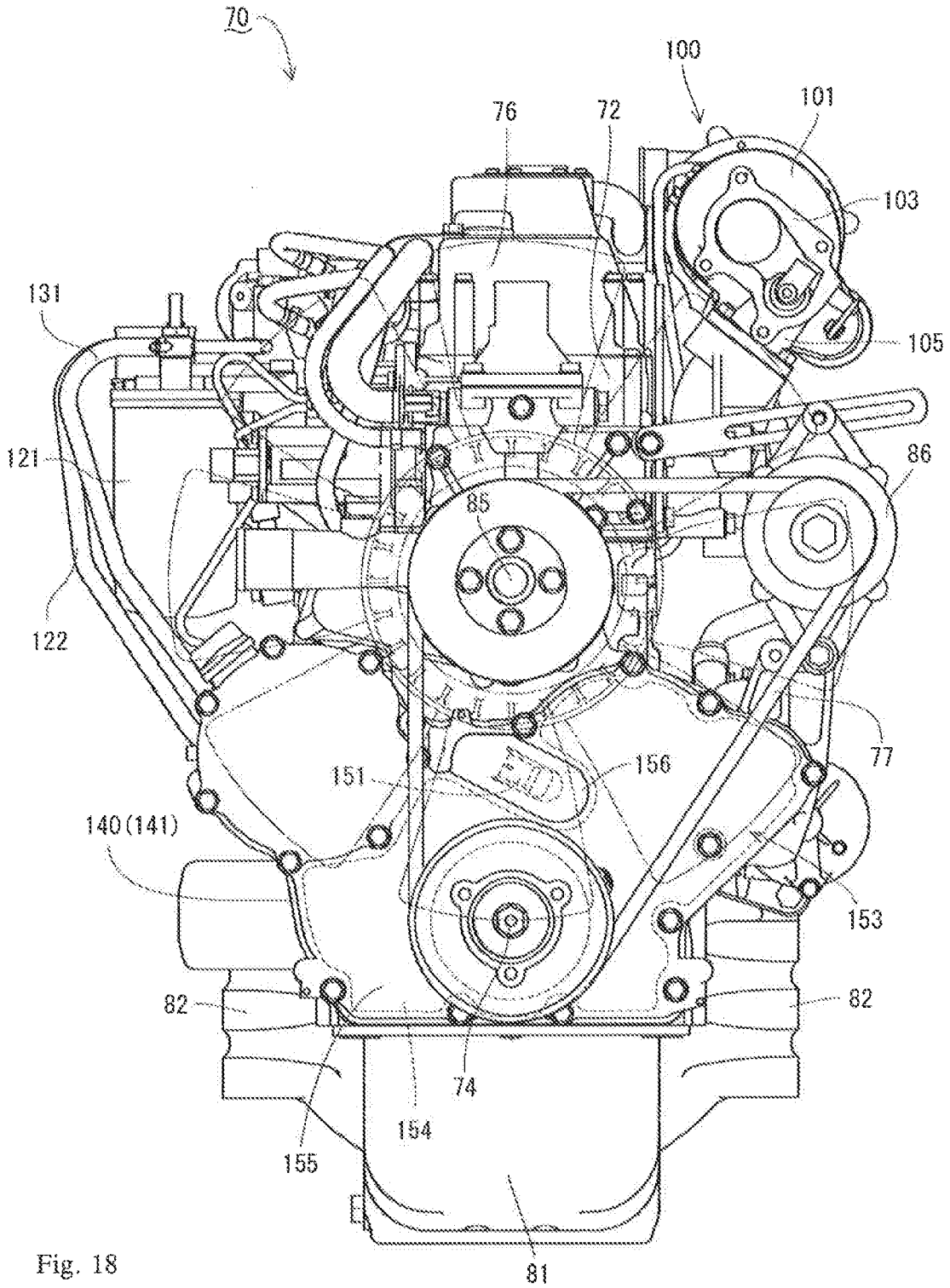
FIG. 18 is a side view showing a gear case of the engine.
Figure 19:
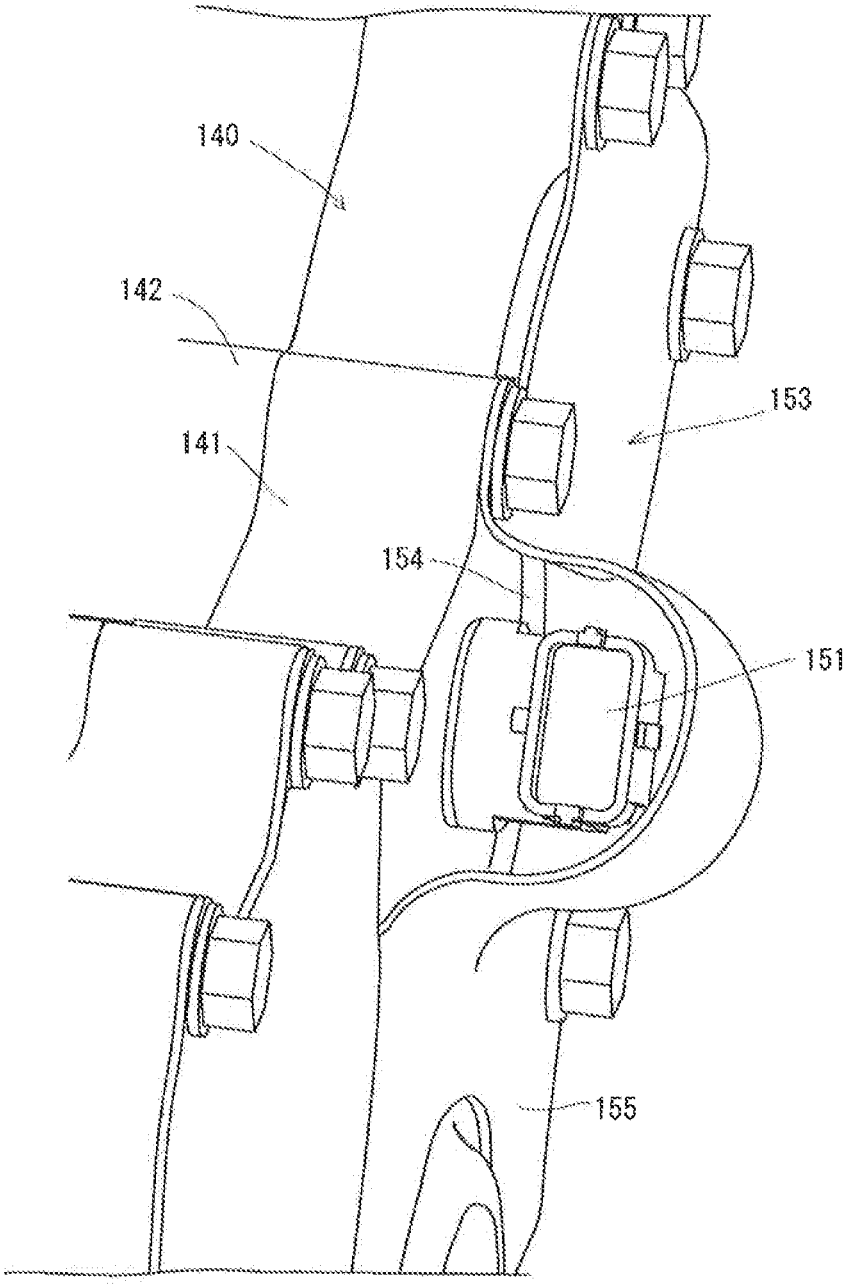
FIG. 19 is a perspective view of an outward appearance showing a gear case of the engine.

As shown in FIGS. 18 and 19, a sound insulation cover body 153 is mounted for isolating noise from the engine 70 on an outer surface of the case lid 141 in the gear case 140 such that the sound insulation cover body 153 is superposed on the outer surface. The sound insulation cover body 153 of the embodiment is formed by pasting an outer layer material 155 on a non-combustible sound absorbing material 154. The sound insulation cover body 153 is fastened to the case lid 141 through a bolt in a state where the sound absorbing material 154 is brought into intimate contact with an outer surface of the case lid 141. The sound insulation cover body 153 of the embodiment is formed into a shape widely covering an outer surface of the case lid 141 except portions thereof corresponding to the crank gear 143 and the pump gear 147.

A portion of the sound insulation cover body 153 which is fitted over the cam shaft rotation angle sensor 151 is a swelling portion 156 which swells in a direction separating away from the gear case 140 (case lid 141). The swelling portion 156 is formed by swelling a portion of the outer layer material 155 in an outward direction separating away from the case lid 141. A portion of the swelling portion 156 corresponding to the sound absorbing material 154 is cut away. In a state where the sound insulation cover body 153 is superposed and mounted on an outer surface of the case lid 141, an accommodating space (gap) is created between the case lid 141 and the swelling portion 156. A base portion of the cam shaft rotation angle sensor 151 is located in this accommodating space. Therefore, if the engine 70 is viewed from the cooling fan 76, the cam shaft rotation angle sensor 151 is hidden behind the swelling portion 156 of the sound insulation cover body 153.

As shown in FIGS. 18 and 19, the swelling portion 156 of the sound insulation cover body 153 is opened upward. A harness (not shown) is inserted from the opened portion and connected to the cam shaft rotation angle sensor 151. In the embodiment, since the base portion of the cam shaft rotation angle sensor 151 is inclined leftward and upward, the swelling portion 156 is inclined such that a left side thereof comes higher than a right side thereof, and the opened portion is oriented leftward and upward.

In the embodiment, as shown in FIG. 18 in detail, the swelling portion. 156 of the sound insulation cover body 153 is located between the fan shaft 85 and a front end of the crankshaft 74. More specifically, the swelling portion 156 is located in a region of the sound insulation cover body 153 which is surrounded by a V-belt 77. That is, effectively utilizing a dead space between the fan shaft 85 and the front end of the crankshaft 74 (especially dead space of sound insulation cover body 153 which is surrounded by V-belt 77), the swelling portion 156 of the sound insulation cover body 153 is disposed while avoiding interference with the cooling fan 76 and the V-belt 77.

2-3. Summary of Second Embodiment

As apparent from the above description and FIGS. 18 to 20, a gear case 140 in which a gear train 143, 145, 147 and 149 is accommodated is mounted on the one side surface of the cylinder block 75 in the direction of the crankshaft 74, the engine 70 includes rotation angle detecting means 151 which detects a rotation angle of rotation gears 145 which constitute the gear train 143, 145, 147 and 149, a sound insulation cover body 153 for insulating noise is mounted on an outer surface of the gear case 140 (141), a swelling portion 156 which swells in a direction separating away from the gear case 140 (141) is formed on the sound insulation cover body 153, and the rotation angle detecting means 151 is disposed in an accommodating space which is surrounded by the gear case 140 (141) and the swelling portion 156. Since the sound insulation cover body 153 exists, it is possible to suppress noise from the engine 70 and protect the rotation angle detecting means 151 from foreign matters such as trash and stones spattered from the ground. Therefore, it is possible to effectively prevent the rotation angle detecting means 151 from being broken or damaged by the spattered stones. Since the sound insulation cover body 153 has both an original sound insulating function and a protecting function of the rotation angle detecting means 151. Therefore, a range of functions of the sound insulation cover body 153 is increased, the number of parts is reduced, and costs are reduced.

As apparent from the above description and FIGS. 18 to 20, the swelling portion 156 of the sound insulation cover body 153 is opened upward. Therefore, a lower side of the rotation angle detecting means 151 is covered with the swelling portion 156. It is easy to protect the rotation angle detecting means 151 from stones which spatter from bottom up. Further, when a harness is connected to the rotation angle detecting means 151, the harness is inserted from the opened portion to a downward direction. Therefore, the wiring operability is excellent.

As apparent from the above description and FIGS. 18 to 20, a fan shaft 85 which rotatably and pivotally supports a cooling fan 76 is provided on one side surface of the cylinder block 75 above the gear case 140, one end of the crankshaft 74 outwardly projects from the gear case 140, and the swelling portion 156 of the sound insulation cover body 153 is located between the fan shaft 85 and one end of the crankshaft 74. Therefore, the swelling portion 156 which outwardly swells can be disposed effectively utilizing a dead space between the fan shaft 85 and the one end of the crankshaft 74 while avoiding interference with the cooling fan 76 and the like. A harness can be routed win the rotation angle detecting means 151 while avoiding the cooling fan 76 and the like, and the wiring operability is enhanced.

As apparent from the above description and FIGS. 18 to 20, a rotation force from the crankshaft 74 is transmitted, through an endless belt 77, to the cooling fan 76 and an alternator 86 disposed on a side of the fan shaft 85, and the swelling portion 156 is located in a region of the sound insulation cover body 153 which is surrounded by the endless belt 77. Therefore, the dead space surrounded by the endless belt 77 can effectively be utilized as a disposition space for the swelling portion 156, and a space can be saved.

3. Others

The invention of the application is not limited to the above-described embodiments, and the invention can variously be embodied. For example, the rotation angle detecting means of the second embodiment is not limited to the cam shaft rotation angle sensor 151 only if it is mounted an outer surface of the gear case 140. The rotation angle detecting means may be a sensor which detects a rotation angle of the pump shaft 146 (pump gear 147). Configurations of various parts are not limited to those of the embodiments, and the configurations can variously be changed in a range not departing from a subject matter of the invention, of the application.

REFERENCE SIGNS LIST

70 Diesel engine
72 Cylinder head
73 Intake manifold
75 Cylinder block
140 Gear case
141 Case lid
144 Cam shaft
145 Cam gear
151 Cam shaft rotation angle sensor (rotation angle detecting means)
153 Sound insulation cover body
156 Swelling portion
160 Head cover
161 Breather passage
163 Differential pressure sensor (differential pressure detecting means)
166 Intake pressure taking-out passage
169 Intake pressure introducing passage
173 Exhaust pressure introducing passage
176 Exhaust pressure taking-out pipe

The invention claimed is:

1. An engine comprising an EGR apparatus which refluxes a portion of exhaust gas from an exhaust system to an intake system as EGR gas, comprising differential pressure detecting means which detects differential pressure between intake pressure in the intake system and exhaust pressure in the exhaust system is mounted on a head cover which covers an upper portion of a cylinder head, an intake pressure taking-out passage which is in communication with the intake system is formed in the cylinder head, an intake pressure introducing passage which is connected to the differential pressure detecting means is formed in the head cover, and the intake pressure taking-out passage and the intake pressure introducing passage are in communication with each other.

2. The engine according to claim 1, wherein the intake pressure introducing passage comprises a vertically oriented vertical introducing passage formed in a sidewall of the head cover, and a laterally oriented lateral introducing passage formed in an upper wall of the head cover, and the lateral introducing passage is formed by forming a case hole in molding dies such that the lateral introducing passage extends in parallel to a breather passage formed in the head cover.

3. The engine according to claim 1, wherein the differential pressure detecting means and the exhaust system are in communication with each other through an external exhaust pressure taking-out pipe, and the exhaust pressure taking-out pipe is installed such that it faces a cooling fan disposed on one side surface of a cylinder block.

4. The engine according to claim 3, wherein the differential pressure detecting means is mounted on an upper surface of the head cover at a location close to the cooling fan.

5. The engine according to claim 1, comprising a gear case in which a gear train is accommodated is mounted on one side surface of the cylinder block in a direction of a crankshaft, the engine includes rotation angle detecting means which detects a rotation angle of rotation gears which constitute the gear train, a sound insulation cover body for insulating noise is mounted on an outer surface of the gear case, a swelling portion which swells in a direction separating away from the gear case is formed on the sound insulation cover body, and the rotation angle detecting means is disposed in an accommodating space which is surrounded by the gear case and the swelling portion.

6. The engine according to claim 5, wherein the swelling portion of the sound insulation cover body is opened upward.

7. The engine according to claim 5, comprising a fan shaft which rotatably and pivotally supports a cooling fan is provided on one side surface of the cylinder block above the gear case, one end of the crankshaft outwardly projects from the gear case, and the swelling portion of the sound insulation cover body is located between the fan shaft and one end of the crankshaft.

8. The engine according to claim 7, wherein a rotation force from the crankshaft is transmitted, through an endless belt, to the cooling fan and an alternator disposed on a side of the fan shaft, and the swelling portion is located in a region of the sound insulation cover body which is surrounded by the endless belt.

9. The engine according to claim 2, wherein the differential pressure detecting means and the exhaust system are in communication with each other through an external exhaust pressure taking-out pipe, and the exhaust pressure taking-out pipe is installed such that it faces a cooling fan disposed on one side surface of a cylinder block.

10. The engine according to claim 6, comprising a fan shaft which rotatably and pivotally supports a cooling fan is provided on one side surface of the cylinder block above the gear case, one end of the crankshaft outwardly projects from the gear case, and the swelling portion of the sound insulation cover body is located between the fan shaft and one end of the crankshaft.

* * * * *